US006966629B2

(12) United States Patent
Nakajima et al.

(10) Patent No.: US 6,966,629 B2
(45) Date of Patent: Nov. 22, 2005

(54) INKJET PRINTHEAD, DRIVING METHOD OF INKJET PRINTHEAD, AND SUBSTRATE FOR INKJET PRINTHEAD

(75) Inventors: Yoshinori Nakajima, Kanagawa (JP); Jiro Moriyama, Kanagawa (JP); Mineo Kaneko, Tokyo (JP); Masafumi Wataya, Kanagawa (JP); Yoshiyuki Imanaka, Kanagawa (JP); Takuya Hatsui, Kanagawa (JP); Muga Mochizuki, Kanagawa (JP); Souta Takeuchi, Kanagawa (JP); Takaaki Yamaguchi, Kanagawa (JP); Kousuke Kubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 10/619,450

(22) Filed: Jul. 16, 2003

(65) Prior Publication Data

US 2004/0021717 A1 Feb. 5, 2004

(30) Foreign Application Priority Data

Jul. 18, 2002 (JP) ..... 2002-210156
Jul. 30, 2002 (JP) ..... 2002-221269

(51) Int. Cl.[7] ..... B41J 2/21
(52) U.S. Cl. ..... 347/43
(58) Field of Search ..... 347/43, 15, 14, 347/10

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
5,739,828 A 4/1998 Moriyama et al.
6,019,453 A * 2/2000 Tsuruoka ..... 347/40
6,137,502 A 10/2000 Anderson et al.
6,158,856 A 12/2000 Sato et al.
6,247,798 B1 6/2001 Cleland et al.
6,309,051 B1 10/2001 Koitabashi et al.
6,325,492 B1 12/2001 Koitabashi et al.
6,450,616 B1 9/2002 Kubota et al.
2002/0001004 A1 1/2002 Mantell et al.
2002/0008733 A1 1/2002 Lee et al.

FOREIGN PATENT DOCUMENTS

EP 0 709 196 5/1996
EP 0 805 029 11/1997
EP 0 885 732 12/1998
EP 1 120 269 8/2001
JP 8-183179 7/1996
JP 9-286108 11/1997

* cited by examiner

*Primary Examiner*—Thinh Nguyen
(74) *Attorney, Agent, or Firm*—Fitzpatrick, Cella, Harper & Scinto

(57) ABSTRACT

To drive an inkjet printhead having an array of printing elements, where the first and second printing elements which discharge relatively different amounts of ink are arranged on the same array in a predetermined direction, print data for the first or second printing element is serially inputted, the inputted print data is sequentially stored, the stored print data is latched, a selection signal indicative of which of the first or second printing element is to be driven is inputted, a driving signal indicative of a driving period is inputted, and respective printing elements are driven in accordance with the latched print data, the selection signal, and the driving signal. Accordingly, it is possible to reduce the cost of the printhead having plural types of printing elements, which discharge relatively different amounts of ink, and possible to easily control driving of the printhead.

13 Claims, 30 Drawing Sheets

FIG. 4

| 2 TO 4 INPUT | | 2 TO 4 Decoder OUTPUT | | | |
|---|---|---|---|---|---|
| BE0 | BE1 | BLE0 | BLE1 | BLE2 | BLE3 |
| L | L | H | L | L | L |
| H | L | L | H | L | L |
| L | H | L | L | H | L |
| H | H | L | L | L | H |

FIG. 5

| SELECTOR INPUT | SELECTOR OUTPUT | |
|---|---|---|
| SELECT | SEL0 | SEL1 |
| L | H | L |
| H | L | H |

FIG. 6

| seg | BLE | SEL |
|---|---|---|
| 0 | 0 | 0 |
| 1 | 0 | 1 |
| 2 | 1 | 0 |
| 3 | 1 | 1 |
| 4 | 2 | 0 |
| 5 | 2 | 1 |
| 6 | 3 | 0 |
| 7 | 3 | 1 |
| 8 | 0 | 0 |
| 9 | 0 | 1 |
| 10 | 1 | 0 |
| 11 | 1 | 1 |
| 12 | 2 | 0 |
| 13 | 2 | 1 |
| 14 | 3 | 0 |
| 15 | 3 | 1 |
| 16 | 0 | 0 |
| 17 | 0 | 1 |
| 18 | 1 | 0 |
| 19 | 1 | 1 |
| 20 | 2 | 0 |
| 21 | 2 | 1 |
| 22 | 3 | 0 |
| 23 | 3 | 1 |
| 24 | 0 | 0 |
| 25 | 0 | 1 |
| 26 | 1 | 0 |
| 27 | 1 | 1 |
| 28 | 2 | 0 |
| 29 | 2 | 1 |
| 30 | 3 | 0 |
| 31 | 3 | 1 |

FIG. 13

| SELECTOR INPUT | SELECTOR OUTPUT | | |
|---|---|---|---|
| SELECT | SEL0 | SEL1 | SEL2 |
| LL | H | L | L |
| LH | L | H | L |
| HL | L | L | H |

FIG. 14

| seg | BLE | SEL |
|---|---|---|
| 0 | 0 | 0 |
| 1 | 0 | 1 |
| 2 | 0 | 2 |
| 3 | 1 | 0 |
| 4 | 1 | 1 |
| 5 | 1 | 2 |
| 6 | 2 | 0 |
| 7 | 2 | 1 |
| 8 | 2 | 2 |
| 9 | 3 | 0 |
| 10 | 3 | 1 |
| 11 | 3 | 2 |
| 12 | 0 | 0 |
| 13 | 0 | 1 |
| 14 | 0 | 2 |
| 15 | 1 | 0 |
| 16 | 1 | 1 |
| 17 | 1 | 2 |
| 18 | 2 | 0 |
| 19 | 2 | 1 |
| 20 | 2 | 2 |
| 21 | 3 | 0 |
| 22 | 3 | 1 |
| 23 | 3 | 2 |
| 24 | 0 | 0 |
| 25 | 0 | 1 |
| 26 | 0 | 2 |
| 27 | 1 | 0 |
| 28 | 1 | 1 |
| 29 | 1 | 2 |
| 30 | 2 | 0 |
| 31 | 2 | 1 |
| 32 | 2 | 2 |
| 33 | 3 | 0 |
| 34 | 3 | 1 |
| 35 | 3 | 2 |
| 36 | 0 | 0 |
| 37 | 0 | 1 |
| 38 | 0 | 2 |
| 39 | 1 | 0 |
| 40 | 1 | 1 |
| 41 | 1 | 2 |
| 42 | 2 | 0 |
| 43 | 2 | 1 |
| 44 | 2 | 2 |
| 45 | 3 | 0 |
| 46 | 3 | 1 |
| 47 | 3 | 2 |

FIG. 17

| SIGNAL | BLACK | CYAN | MAGENTA | YELLOW |
|---|---|---|---|---|
| SELECT | Non | A1 | A2 | A3 |
| BLOCK DATA | B | B | B | B |
| HEAT ENABLE | C1 | C2 | C2 | C2 |
| LATCH TRIGGER | D | D | D | D |
| DATA | E1 | E2 | E3 | E4 |
| CLOCK | F | F | F | F |

FIG. 18

| SIGNAL | BLACK | CYAN | MAGENTA | YELLOW |
|---|---|---|---|---|
| SELECT | Non | A | A | A |
| BLOCK DATA | B | B | B | B |
| HEAT ENABLE | C1 | C2 | C2 | C2 |
| LATCH TRIGGER | D | D | D | D |
| DATA | E1 | E2 | E3 | E4 |
| CLOCK | F | F | F | F |

INKJET PRINTHEAD, DRIVING METHOD OF INKJET PRINTHEAD, AND SUBSTRATE FOR INKJET PRINTHEAD

FIELD OF THE INVENTION

The present invention relates to an inkjet printhead and a driving method of an inkjet printhead, and more particularly, to an inkjet printhead having first and second printing elements which discharge relatively different amounts of ink, and a driving method of the printhead.

Furthermore, the present invention relates to an inkjet printhead, which performs printing by discharging ink by growth and shrinkage of the bubbles in ink caused by heat energy generated by heating resistances, and a substrate for the printhead.

BACKGROUND OF THE INVENTION

Inkjet printers are mostly known as printing devices used in printers, copying machines, or the like. Particularly, inkjet printers that employ a method utilizing heat energy as ink discharging energy and discharge ink by bubbles generated by the heat energy have recently come into general use.

An inkjet printhead, used in the above-described inkjet printers, employs an electrothermal transducer (hereinafter referred to as a heater) for generating heat energy. And in many cases, one heater is provided for one discharge orifice (nozzle).

Meanwhile, as disclosed in Japanese Patent Application Laid-Open No. 08-183179, there is a technique which enables printing in various printing modes by utilizing an inkjet printhead comprising plural heaters for one discharge orifice to vary the amount of ink discharged from each discharge orifice.

For example, one inkjet print head can realize both high-speed printing and high-quality printing by the following functions. That is, in the high-speed mode, high-speed printing with a low printing resolution is realized by increasing the amount of ink droplets discharged from respective discharge orifices so as to enlarge the size of a dot that can be printed by one ink droplet. In the high-quality mode, printing is realized at a high printing resolution by reducing the amount of ink droplets discharged from respective discharge orifices so as to reduce the size of a dot that can be printed by one ink droplet.

This compatibility of the printhead provides a great advantage in that a user can obtain a desired output image by selecting the most appropriate printing mode.

Japanese Patent Application Laid-Open No. 09-286108 discloses an inkjet printhead to meet the demands. It discloses a technique for achieving a high tonality by providing a plurality of heaters in one nozzle to change the size of a printing dot.

FIG. 27 shows an equivalent circuit of an electric circuit formed on the printhead substrate, disclosed in the aforementioned Japanese Patent Application. The circuit includes: multi-valued heaters in the ink-flowing channel which forms one nozzle; NMOS transistors 301 serving as a driving transistor for independently driving the elements 201(1), 201(2), . . . , 201(*n*) which serve as the multi-valued heaters; a shift register 302 configured with a CMOS transistor for processing a driving signal; a latch circuit 303 for holding data; and AND circuits 307 connected to the respective transistors 301.

The AND circuits 307 perform a logical operation on a block selection signal (Block ENB) 304 which divides the ink-flowing channel forming a nozzle into blocks, a select signal (Select) 305, data thereof, and a driving pulse signal (Heat ENB) 306, and drive the corresponding transistors 301 based on a result of the operation. Group S is formed by S(1) to S(m) so as to correspond to the number of ink-flowing channels m.

An electrode wiring 203 individually supplies electric power to one end of the elements 201 (1), 201(2), . . . , 201(*n*) serving as the n numbers of multi-valued heaters provided in one nozzle. Each of the other ends of the multi-valued heaters is connected to a common power source 309. Furthermore, a temperature adjusting sub-heater 311, a temperature sensor 312, and a heater resistance value monitoring heater 313 are provided.

In FIG. 27, VDD denotes a logic power source, HGND denotes a GND for the heater-driving power source 309, and L-GND denotes a GND for the logic power source VDD. The heater-driving power source 309 is connected to an end portion of all the elements 201(1) to 201(*n*) of the groups S(1) to S(m). The shift register 302 inputs a serial image data input signal (Idata) that corresponds to each of the groups S(1), S(2), . . . , (Sm) and a clock input signal (Clock) for driving the shift register, and outputs the image data to the latch circuit 303 as a parallel signal. To the latch circuit 303, a reset signal (Reset) and a latch signal (LTCLK) are inputted. The latch circuit 303 temporarily stores the image data inputted from the shift register 302, and outputs it to the AND circuits 307 of the respective groups S(1), S(2), . . . , S(m). The driving pulse signal (Heat ENB) 306 is inputted to the respective heaters 201(1), 201(2), . . . , 201(*n*) of the groups S(1) to S(m).

The select signal 305 in FIG. 27 is inputted to the input terminals 1 to n (Select 1-n) that are commonly provided to the groups S(1) to S(m). By the select signal 305, heaters subjected to heating in the respective groups S(1) to S(m) can be selected.

In FIG. 27, numeral 314 denotes a decoder. The block selection signal 304 is inputted to input terminals 1, 2 and 3 of the decoder 314. Five output terminals of the decoder 314 are connected to the AND circuits 307 of the respective groups S(1) to S(m). For instance, assuming that the number of groups S is 160 (S(1) to S(160)), i.e., the number of nozzles is 160, the first output terminal of the five output terminals is connected to AND circuits 307 of the groups S(1) to S(20) that correspond to the nozzle numbers 1 to 20. The second output terminal is connected to AND circuits 307 of the groups S(21) to S(40) that correspond to the nozzle numbers 21 to 40. The third output terminal is connected to AND circuits 307 of the groups S(41) to S(60) that correspond to the nozzle numbers 41 to 60. The fourth output terminal is connected to AND circuits 307 of the groups S(61) to S(80) that correspond to the nozzle numbers 61 to 80. The fifth output terminal is connected to AND circuits 307 of the groups S(81) to S(100) that correspond to the nozzle numbers 81 to 100. The sixth output terminal is connected to AND circuits 307 of the groups S(101) to S(120) that correspond to the nozzle numbers 101 to 120. The seventh output terminal is connected to AND circuits 307 of the groups S(121) to S(140) that correspond to the nozzle numbers 121 to 140. The eighth output terminal is connected to AND circuits 307 of the groups S(141) to S(160) that correspond to the nozzle numbers 141 to 160.

In a case where the decoder 314 is connected in the above-described manner, 8 blocks of nozzles, each connected to the same output terminal of the decoder 314, are selected as nozzles to be heated for discharging ink in accordance with the block selection signal 304, and the ink discharge timing of the 8 blocks of nozzles can be controlled.

Next, a detailed configuration of an inkjet printhead is described.

FIG. 28 is a diagrammatic cross-section showing a part of a printhead having a conventional configuration.

Numeral 901 denotes a p-type semiconductor substrate formed with monocrystal silicon. Numeral 912 denotes a p-type well area; 908, an n-type drain area; 916, an n-type electric field relaxing drain area; 907, an n-type source area; and 914, a gate electrode. The above-described components form a MIS (Metal Insulator Semiconductor)-type field effect transistor 930, which serves as a switch device using an MIS-type field effect transistor. Numeral 917 denotes a silicon oxide layer serving as a thermal storage layer and an insulating layer; 918, a tantalum nitride layer serving as a thermal resistance layer; 919, an aluminum alloy layer serving as a wiring; and 920, a silicon nitride layer serving as a protection layer. The foregoing layers constitute a printhead base 940. Numeral 950 denotes a heating portion. Ink is discharged from an ink discharge portion 960. A top plate 970 and the printhead base 940 form a liquid path 980.

Various improvements have been made on the printhead and switch device having the above-described configuration. Recently, there are increasing demands for high-speed driving, energy saving, high integration, low cost, and high performance of the product. Therefore, a plurality of MIS-type field effect transistors 930 shown in FIG. 28, serving as a switch device, are provided in the semiconductor substrate 901, and alone or a plurality of the MIS-type field effect transistors 930 are simultaneously operated to drive the electrothermal transducers connected.

However, if the conventional MIS-type field effect transistor 930 is used under a large electric current which is necessary for driving the electrothermal transducers, the p-n reverse bias junction between the drain and well cannot withstand the intense electric field, generating a leak current. Therefore, it cannot withstand the pressure required as a switch device. Furthermore, if the MIS-type field effect transistor serving as a switch device has a large resistance when it is turned on, an unnecessary current is consumed. Therefore, a current necessary for driving the electrothermal transducers cannot be obtained.

To solve the problem of the withstanding pressure, an MIS-type field effect transistor 1020 shown in FIG. 29 may be considered.

In FIG. 29, a semiconductor substrate 1001, an n-type source area 1007, an n-type drain area 1008, a gate electrode 1004, a silicon oxide layer 1017 serving as a thermal storage layer and an insulating layer, a tantalum nitride layer 141 serving as a thermal resistance layer, an aluminum alloy layer 154 serving as a wiring, a silicon nitride layer 1020 serving as a protection layer, a printhead base 152, a heating portion 1050, an ink discharge portion 153, a top plate 156, and a liquid path 155 are respectively similar to the aforementioned semiconductor substrate 901, n-type source area 907, n-type drain area 908, gate electrode 914, silicon oxide layer 917 serving as a thermal storage layer and an insulating layer, tantalum nitride layer 918 serving as a thermal resistance layer, aluminum alloy layer 919 serving as a wiring, silicon nitride layer 920 serving as a protection layer, printhead base 940, heating portion 950, ink discharge portion 960, top plate 970, and liquid path 980 shown in FIG. 28.

The configuration of the MIS-type field effect transistor shown in FIG. 29 is different from that of an ordinary transistor. In the p-type semiconductor substrate 1001, the n-type source area 1007 is surrounded by a p-type base area 1005, so that a part of the n-type well area 1002 is used as a drain. This is called a DMOS (Double diffused MOS transistor). By forming a channel within a drain as described above with the use of the n-type well area 1002, it is possible to deepen the drain that determines the withstanding pressure and to form the drain at low density, making it possible to solve the problem of withstanding pressure.

Although such a configuration as disclosed in the above-described Japanese Patent Application Laid-Open No. 09-286108 can achieve a high tonality, it requires a plurality of driving circuits, and it is necessary to provide selection signal input terminals for selecting plural heaters. Therefore, it raises a problem of an enlarged size of the substrate to be solved.

However, in a case of employing an inkjet printhead where one heater is provided for one discharge orifice, it is difficult to change the ink discharge amounts in multi-levels to be discharged from one orifice.

Furthermore, if the configuration where plural heaters are provided for one discharge orifice is adopted to change the ink discharge amounts in multi-levels, the circuit formed on the substrate of the inkjet printhead becomes complicated, because the number of heaters and driving circuits thereof becomes as many as multiple times of the number of discharge orifices, and the driving circuits for the plural heaters should be localized for each discharge orifice in layout. As a result, the cost of the printhead increases.

As described above, it is desirable to provide a printhead which enables to discharge relatively different amounts of ink with a simple structure.

SUMMARY OF THE INVENTION

The present invention has been proposed to solve the conventional problems, and has as its object to provide a low-cost and easy-to-control inkjet printhead having plural types of printing elements, which discharge relatively different amounts of ink, in a simple structure.

In order to attain the object, an inkjet printhead according to the first aspect of the present invention has the following configuration. More specifically, the inkjet printhead has an array of printing elements, where first and second printing elements which discharge relatively different amounts of ink are arranged on the same array in a predetermined direction, and the print head comprises: storage means for sequentially storing print data that is serially inputted; holding means for holding the print data stored in the storage means; and a driving control circuit for driving respective printing elements in accordance with a selection signal indicative of which of the first or second printing element is to be driven, the print data held by the holding means, and a driving signal indicative of a driving period, wherein the print data is inputted to either the first or second printing element.

Furthermore, in order to attain the foregoing object, a driving method of an inkjet printhead according to the first aspect of the present invention has the following steps. More specifically, the driving method of an inkjet printhead having an array of printing elements, where first and second printing elements which discharge relatively different amounts of ink are arranged on the same array in a predetermined direction, comprises: a data input step of serially inputting print data for the first or second printing element; a storing step of sequentially storing the inputted print data; a holding step of holding the stored print data; a selecting step of inputting a selection signal, indicative of which of the first or second printing element is to be driven; a driving designation step of inputting a driving signal indicative of a driving period; and a driving control step of driving respective printing elements in accordance with the print data held, the selection signal, and the driving signal.

Furthermore, the foregoing object is also attained by an inkjet printhead according to the second aspect of the present invention. More specifically, the inkjet printhead has first and second printing elements which discharge relatively different amounts of ink, and comprises: storage means for sequentially storing print data that is serially inputted; holding means for holding the print data stored in the storage means; a driving control circuit for driving respective printing elements in accordance with a selection signal indicative of which of the first or second printing element is to be driven, the print data held by the holding means, and a driving signal indicative of a driving period; and a signal line, to which the print data and the selection signal are serially inputted.

Furthermore, the foregoing object is also attained by a driving method of an inkjet printhead according to the second aspect of the present invention. More specifically, the driving method of an inkjet printhead having first and second printing elements which discharge relatively different amounts of ink, comprises: a storing step of sequentially storing print data that is serially inputted; a holding step of holding the print data stored; an input step of inputting a selection signal indicative of which of the first or second printing element is to be driven; and a driving control step of driving respective printing elements in accordance with the print data held, and a driving signal indicative of a driving period, wherein the print data and the selection signal are serially inputted from a same signal line.

In other words, according to the first aspect of the present invention, in a case of driving an inkjet printhead having an array of printing elements, where the first and second printing elements which discharge relatively different amounts of ink are arranged on the same array in a predetermined direction, print data for the first or second printing element is serially inputted, the inputted print data is sequentially stored, the stored print data is latched, a selection signal indicative of which of the first or second printing element is to be driven is inputted, a driving signal indicative of a driving period is inputted, and the respective printing elements are driven in accordance with the latched print data, the selection signal, and the driving signal.

By virtue of this configuration, even in a case where the printhead is constructed with first and second printing elements which discharge relatively different amounts of ink and are arranged on the same array, for instance, assuming that the number of the first printing elements and the number of the second printing elements are the same, the number of print data inputted at once becomes half the number of all printing elements. Therefore, the amount of data stored and held is cut down to half the number of printing elements. Also, printing performed by the first or second printing element can be realized with simple driving control.

Therefore, it is possible to reduce the cost of the inkjet printhead having plural types of printing elements, which discharge relatively different amounts of ink, and possible to easily control driving of the printhead.

The array of printing elements may include a same number of the first and second printing elements that are arranged alternately, and is configured such that one print data is inputted to a pair of adjacent first and second printing elements.

Preferably, the printhead is configured such that the first and second printing elements are divided into a plurality of blocks to be driven, each including an equal number of first and second printing elements, wherein the print data is inputted to each of the plurality of blocks, and the driving control circuit drives respective printing elements in accordance with the selection signal, the print data held by the holding means, the driving signal, and a block signal designating a block to be driven.

The selection signal may be serially inputted subsequent to the print data, and is separated from an output of the holding means.

The array of printing elements may be provided for at least two colors so as to enable color printing using plural colors.

In this case, the plural colors may include cyan, magenta, yellow, and black, and the selection signal is separately inputted to the at least two arrays of printing elements.

Further, the selection signal may be commonly inputted to the at least two arrays of printing elements.

Preferably, the printing elements perform printing by utilizing heat energy.

Furthermore, according to the second aspect of the present invention which provides an inkjet printhead having the first and second printing elements which discharge relatively different amounts of ink, serially inputted print data is sequentially stored, the stored print data is latched, respective driving elements are driven in accordance with a selection signal indicative of which of the first or second printing element is to be driven, the latched print data, and a driving signal indicative of a driving period by serially inputting the print data and selection signal.

By virtue of the above configuration, a selection signal (data) for changing the amount of discharge can be transmitted in the similar manner to print data. Therefore, it is possible to reduce the number of signal terminals.

Accordingly, it is possible to reduce the cost of the inkjet printhead having plural types of printing elements, which discharge relatively different amounts of ink, and possible to easily control driving of the printhead.

The print data may be serially inputted to the signal line subsequent to the selection signal.

In this case, the data for the first or second printing element may be inputted per one input of the print data.

Furthermore, the foregoing object is also attained by a substrate for an inkjet printhead according to the present invention. More specifically, as to the substrate for an inkjet printhead which discharges ink by utilizing heat energy generated by a plurality of heaters incorporated in the substrate, the heaters divided into m groups each having n heaters, the substrate comprises: m x n driving circuits, provided in correspondence with each of the heaters, for driving each of the heaters; a selection data transfer circuit for separating input data into image data for driving m heaters and a selection signal for selecting m groups and n heaters constituting each group; a holding circuit for inputting the image data for driving the m heaters, received from the selection data transfer circuit, to supply the image data in units of each group to the heaters constituting each of the m groups; and a selection data holding circuit for inputting the selection signal for selecting the m groups and n heaters constituting each group, received from the selection data transfer circuit, to select the heaters to be driven via the driving circuits, wherein the n heaters are arranged opposite to each other in a zigzag manner with an ink supplying orifice at the center, and the selection data holding circuit selects one of the n heaters constituting each group.

The n heaters may have an equal size, and amounts of ink discharged from the heaters by heat energy generated may be equal, or the n heaters may have different sizes, and amounts of ink discharged from the heaters by heat energy generated may be different.

Preferably, each of the driving circuits is configured with a DMOS transistor.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4 is a chart showing input/output characteristics of a decoder shown in FIG. 3;

FIG. 5 is a chart showing input/output characteristics of a selector shown in FIG. 3;

FIG. 6 is a chart showing a driving condition of each seg of the printhead according to the first embodiment;

FIG. 13 is a chart showing input/output characteristics of a selector according to the fourth embodiment;

FIG. 14 is a chart showing a driving condition of each seg of the printhead according to the fourth embodiment;

FIG. 17 is a chart showing types of signals transmitted to each array of discharge orifices of the printhead according to the fifth embodiment;

FIG. 18 is a chart showing types of signals transmitted to each array of discharge orifices of a printhead according to the sixth embodiment;

DETAILED DESCRIPTION OF THE PREFERRED EMBODIMENTS

Preferred embodiments of the present invention will now be described in detail in accordance with the accompanying drawings.

In this specification, "print" means not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as a "liquid" hereinafter) should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Figure 1A:
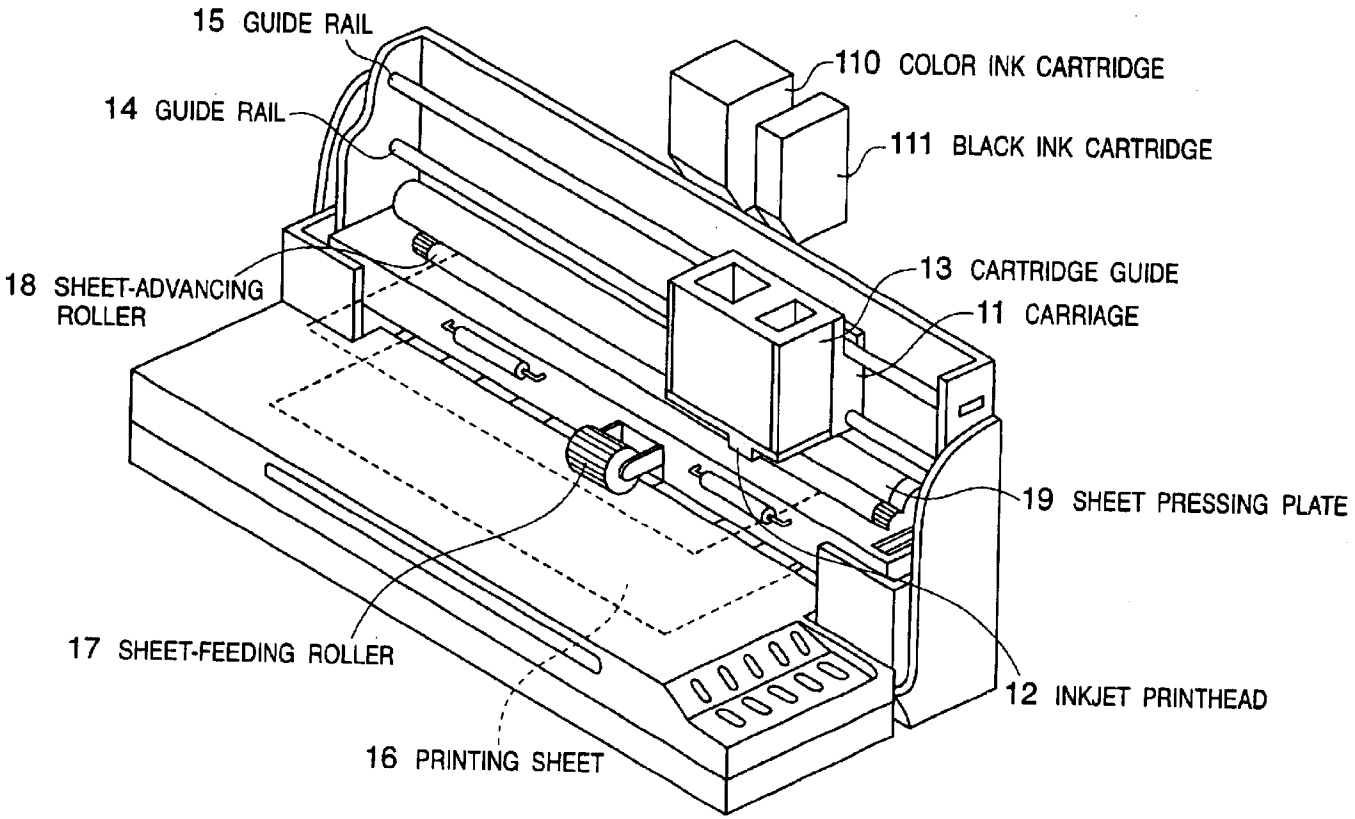
FIG. 1A is a perspective view of an inkjet printer employing a printhead according to the present invention.

First, a description is provided on an inkjet printer which performs printing using the printhead according to the present invention. FIG. 1A is a diagrammatic perspective view of the inkjet printer, shown with the cover being removed.

A carriage 11, loading an inkjet printhead 12 and a cartridge guide 13, is capable of moving in a scanning direction parallel to the two guide rails 14 and 15 by a motor (not shown). As detection means for detecting a position of the carriage, an encoder (not shown) is provided. The encoder comprises, for instance, a scale having slits at predetermined intervals in the direction parallel to the guide rails of the printer, and a sensor for detecting a reflection signal from the scale, which is located at a position opposed to the carriage.

A printing sheet 16 is held tightly by a sheet-feeding roller 17, a sheet-advancing roller 18, and a sheet pressing plate 19, and conveyed by rotation of the sheet-advancing roller 18 to the printing area at the front of the inkjet printhead 12, where printing is performed.

A color ink cartridge 110 which houses three colors of ink: yellow, magenta, and cyan, and a black ink cartridge 111 which contains black ink are separately inserted into the cartridge guide 13, and connected to the inkjet printhead 12 having an array of discharge orifices for respective colors.

Next, the control structure for performing the printing control of the above apparatus is described.

Figure 19:
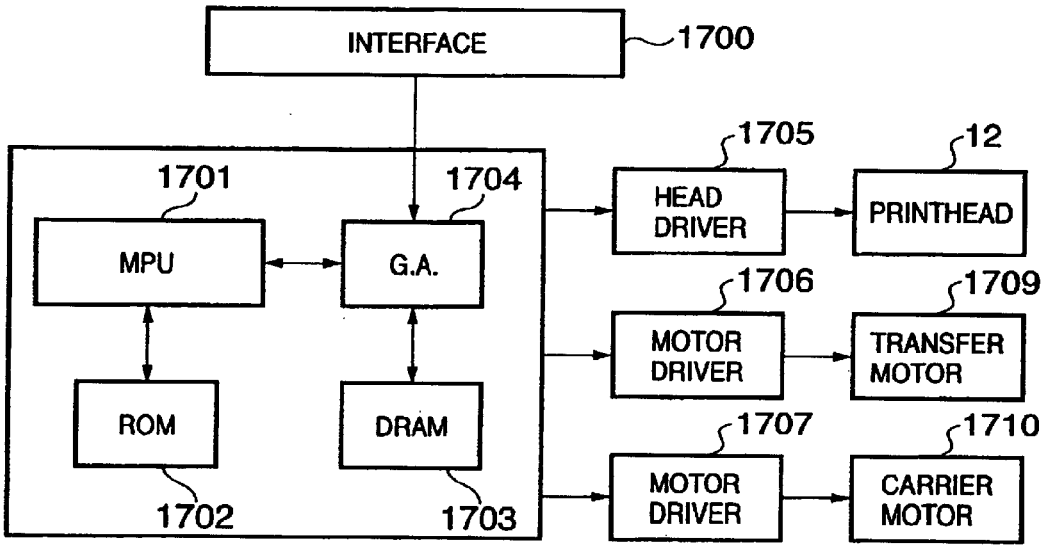
FIG. 19 is a block diagram showing a configuration for controlling the printer shown in FIG. 1A.

FIG. 19 is a block diagram showing the arrangement of a control circuit of the ink-jet printer. Referring to FIG. 19 showing the control circuit, reference numeral 1700 denotes an interface for inputting a print signal from an external unit such as a host computer; 1701, an MPU; 1702, a ROM for storing a control program (including character fonts if necessary) executed by the MPU 1701; and 1703, a DRAM for storing various data (the print signal, print data supplied to the printing head and the like). Reference numeral 1704 denotes a gate array (G. A.) for performing supply control of print data to the printing head IJH. The gate array 1704 also performs data transfer control among the interface 1700, the MPU 1701, and the RAM 1703. Reference numeral 1710 denotes a carrier motor for transferring the printing head IJH in the main scanning direction; and 1709, a transfer motor for transferring a paper sheet. Reference numeral 1705 denotes a head driver for driving the printing head; and 1706 and 1707, motor drivers for driving the transfer motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printing head is driven in accordance with the print data supplied to the head driver 1705, thus performing the printing operation.

Though the control program executed by the MPU 1701 is stored in the ROM 1702, an arrangement can be adopted in which a writable storage medium such as an EEPROM is additionally provided so that the control program can be altered from a host computer connected to the ink-jet printer IJRA.

Hereinafter, embodiments of the printhead according to the present invention are described.

As a preliminary example, one of the illustrative printheads adopting the method discharging ink by utilizing heat energy, a so-called side-shooter inkjet printhead, which discharges an ink droplet upward in the vertical direction of the surface where heaters generate the heat energy, will be described. An inkjet printhead of this type generally supplies ink from the backside of the substrate, where the heaters are arranged, and discharges the ink through an ink supplying orifice penetrating the substrate.

Figure 26:
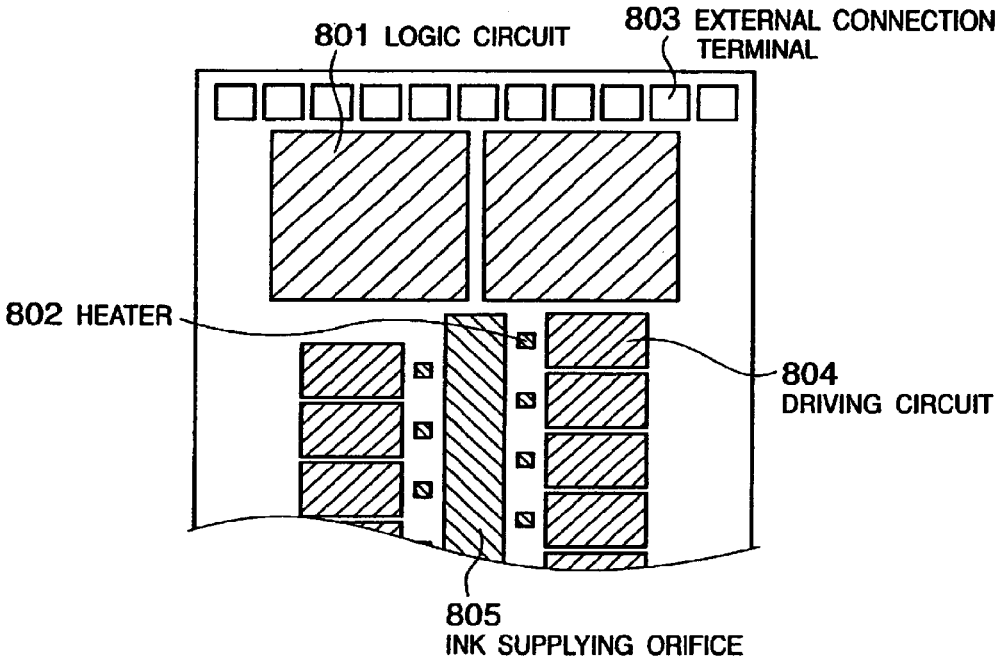
FIG. 26 is a top view of a side-shooter inkjet printhead.
Figure 27:
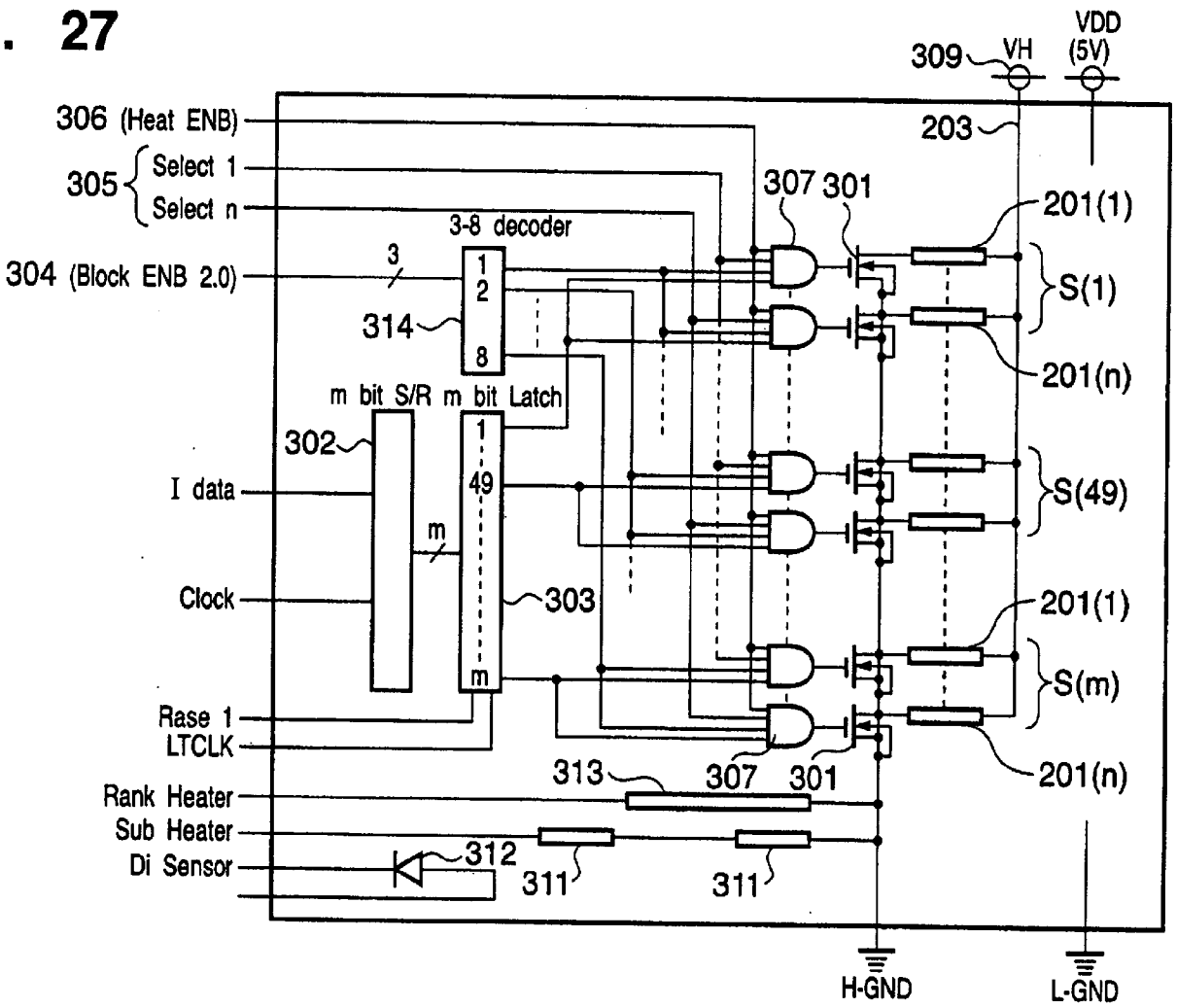
FIG. 27 is a circuit diagram of a conventional example.
Figure 28:
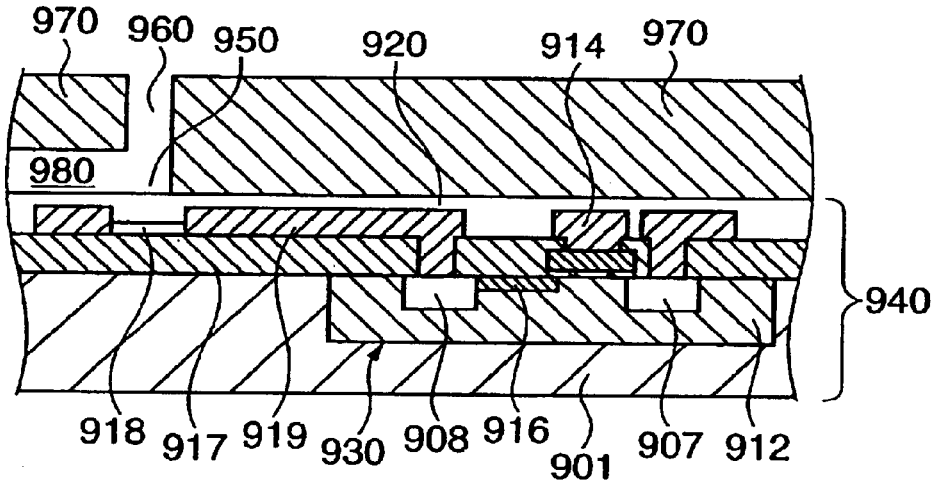
FIG. 28 is a diagrammatic cross-section showing a part of a printhead having a conventional configuration.

FIG. 26 is a top view of a substrate (element board) for a side-shooter inkjet printhead, which shows a layout of each constituent element.

On the substrate, logic circuits 801 for distributing print data and designating driving order of each heater, a plurality of heaters 802 and driving circuits 804, external connection terminals 803, and an ink supplying orifice 805 are provided.

The plurality of driving circuits 804 are provided corresponding to each of the plurality of heaters 802, and selectively drive the heaters 802 in accordance with print data outputted from the logic circuit 801. The logic circuits 801 control the driving state of each driving circuit 804 in accordance with a signal supplied by an external unit through the external connection terminals 803.

The external connection terminals 803 are provided on an end portion of the substrate. The heaters 802 are provided independently on the left and right of the ink supplying orifice 805.

For the purpose of simplified description, the following description is provided with regard to one array of discharge orifices corresponding to one type of ink.

[First Embodiment]

Figure 1B:
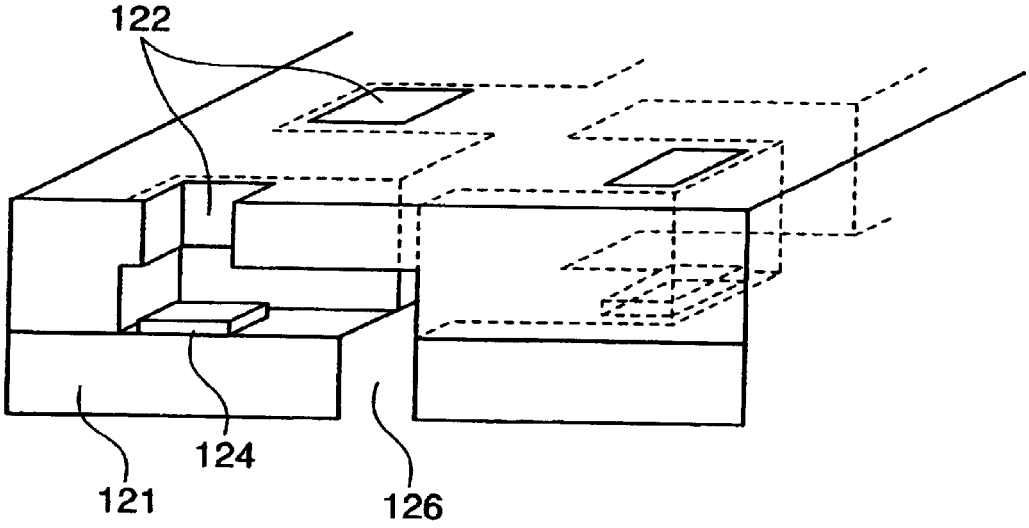
FIG. 1B is a schematic view showing a configuration of an inkjet printhead according to the present invention.

FIG. 1B is a schematic sectional view for describing a configuration of the first embodiment of the inkjet printhead employed in the above-described printer. In an ink channel communicating with discharge orifices 122, heating elements (heaters) 124 respectively corresponding to the discharge orifices 122 are provided. When predetermined energy is applied to the heaters 124 by the head driving circuit, film boiling causes a change of state in ink, i.e., a foaming phenomenon, thereby discharging ink droplets from the discharge orifices 122.

Note that the heaters 124 are formed on the silicon substrate 121 by a technique similar to the semiconductor process. Numeral 126 denotes an ink supply port for supplying ink to each of the discharge orifices from a rear side of the element board.

Figure 2:
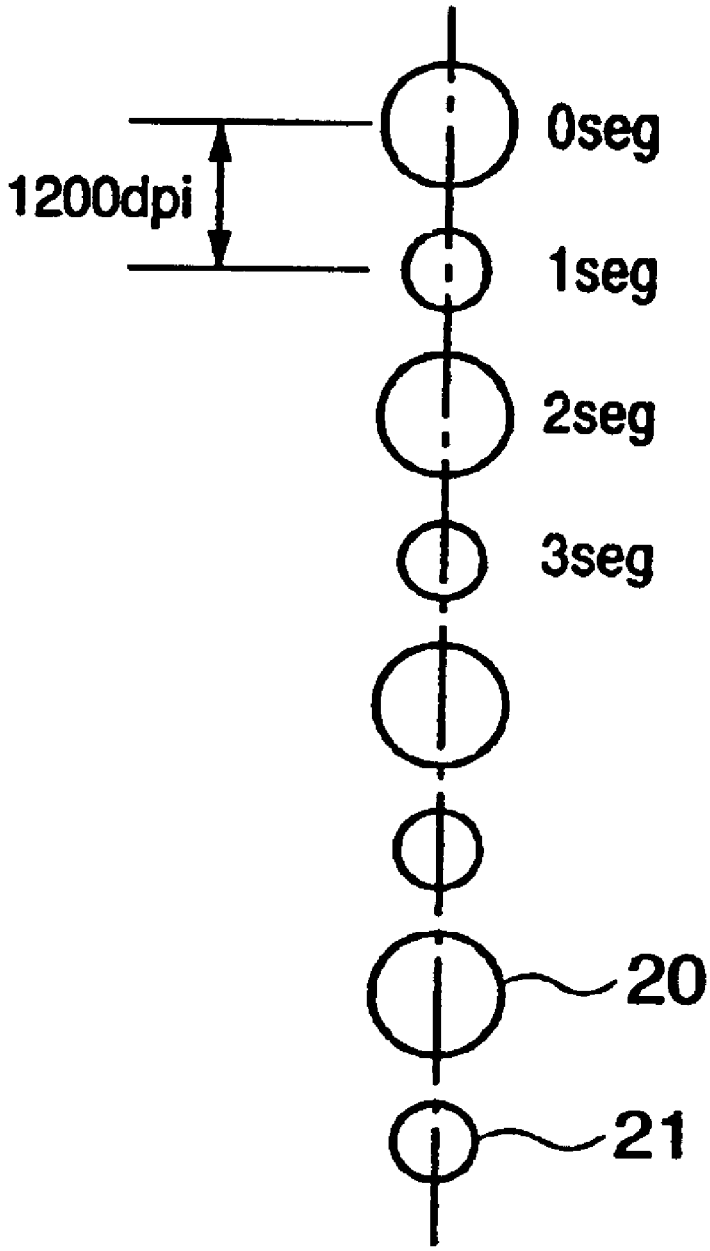
FIG. 2 shows an array of discharge orifices of a printhead according to the first embodiment.

FIG. 2 shows an array of discharge orifices of the printhead according to the first embodiment. To discharge two different types of ink droplets: large and small ink droplets, a discharge orifice (large discharge orifice) 20 which discharges a droplet having a large amount of ink and a discharge orifice (small discharge orifice) 21 which discharges a droplet having a small amount of ink are alternately arranged on a line at intervals of 1200 dpi. There are 32 discharge orifices, which are referred to as 0seg, 1seg, . . . , 31seg from the top. The amount of ink discharge is about 5 pl for the discharge orifice 20, and about 2 pl for the discharge orifice 21.

As described above, according to the first embodiment, each array of discharge orifices comprises discharge orifices (nozzles) for discharging different sizes of ink droplets. In accordance with a printing mode set by a user, discharge orifices to be used for printing are selected. For instance, in a high-speed printing mode, the large discharge orifices are used, whereas in a high-quality printing mode, the small discharge orifices are used. By using both types of discharge orifices, multi-tone images can be printed by using, e.g., an areal tonality representation or the like.

Figure 3:
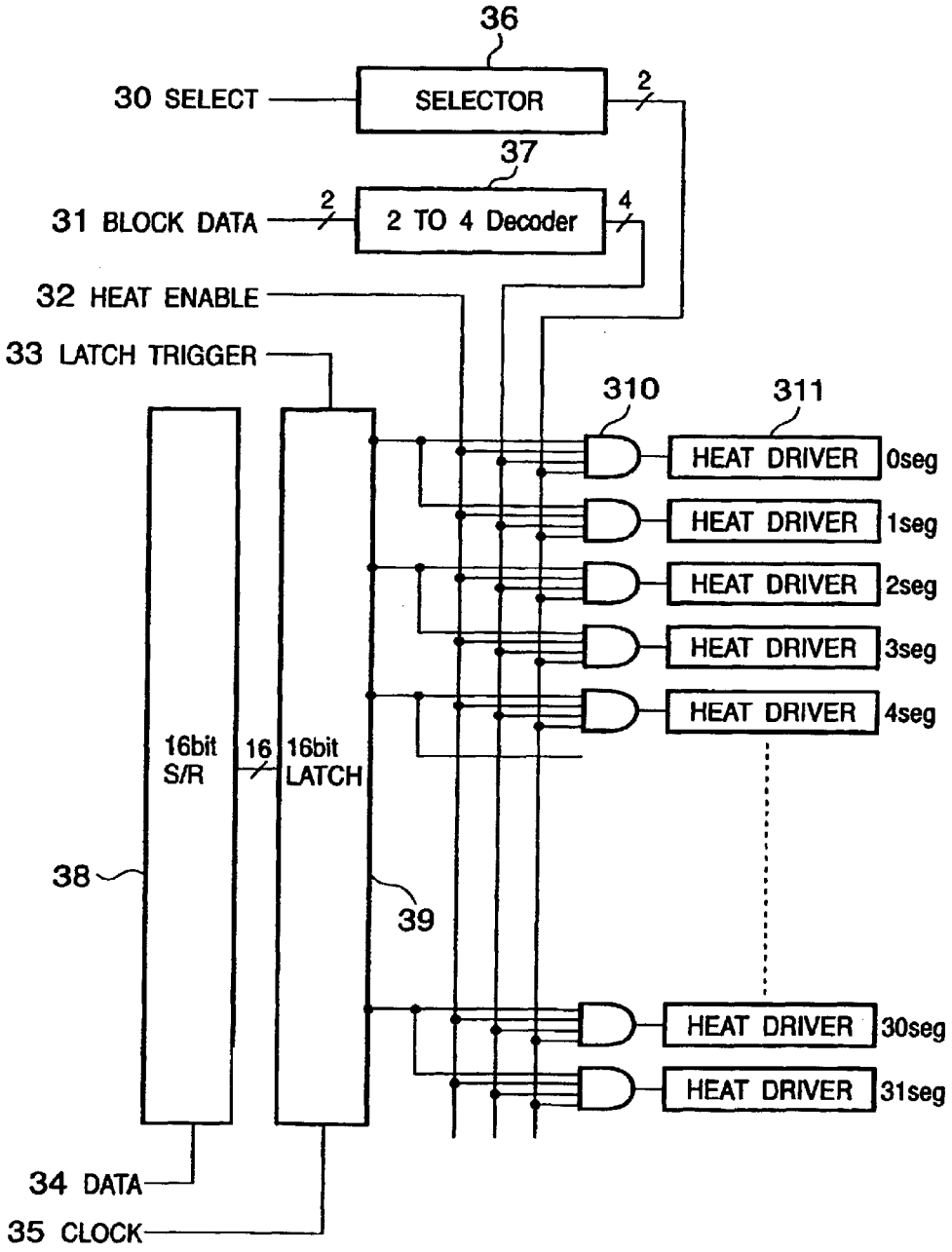
FIG. 3 is a block diagram showing a configuration of a driving circuit of the printhead according to the first embodiment.

FIG. 3 is a block diagram showing a configuration of a driving circuit for discharging an ink droplet from the discharge orifices of the aforementioned printhead. A select signal 30, inputted and decoded by a selector 36, is inputted to AND gates 310 which are connected to respective heat drivers 311. Block data 31, decoded from 2 bits to 4 bits by a 2-to-4 decoder 37, is inputted to the AND gates 310. A heat enable signal 32 for applying a heat pulse to each heater is also inputted to the AND gates 310.

By a data signal 34, print data is serially inputted to a 16-bit shift register 38 in synchronization with a clock 35. The print data is held in a latch 39 at the input timing of a latch trigger 33, and inputted to the respective AND gates. To each set of heat drivers corresponding to large and small discharge orifices, e.g., 0seg and 1seg, 2seg and 3seg, and so on, the same latch data is inputted. In accordance with a signal from the selector 36, heat drivers for the large discharge orifices (even-number seg) or small discharge orifices (odd-number seg) are selected.

In the foregoing manner, the heat drivers 311 are selectively driven in accordance with the four signals inputted to respective AND gates 310 and heat pulses are applied to respective heaters, thereby discharging ink droplets from corresponding discharge orifices.

FIG. 4 shows input/output characteristics of the 2-to-4 decoder 37. As shown in FIG. 4, in accordance with the combination of two input signals BE0 and BE1, the signals are decoded such that one of four output signals BLE0 to BLE3 outputs "High (H)".

FIG. 5 shows input/output characteristics of the selector 36. As shown in FIG. 5, in accordance with the state of the select signal 30, one of the output signals SEL0 and SEL1 outputs "High (H)".

FIG. 6 shows a driving condition of each seg (heat driver). As shown in the chart, each seg (heat driver) is driven in accordance with the state of an output signal (BLE) of the 2-to-4 decoder 37 and the state of an output signal (SEL) of the selector 36. The printhead according to the first embodiment is divided into 4 blocks, and in accordance with the signal SEL, even-number seg (heat drivers) or odd-number seg (heat drivers) are selectively driven.

Figure 7:
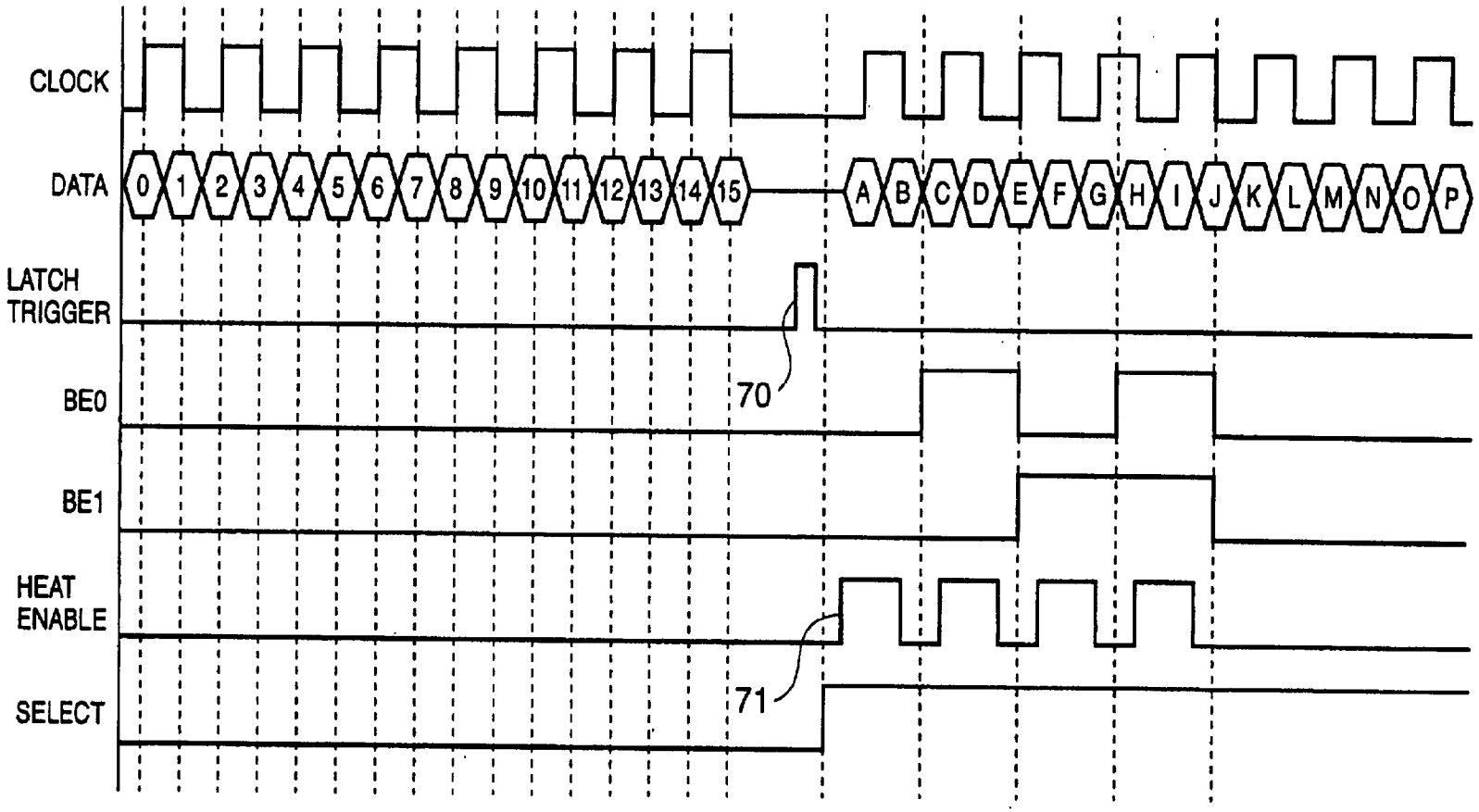
FIG. 7 is a timing chart showing a state of each signal in the circuit shown in FIG. 3.

FIG. 7 is a timing chart showing a state of each signal shown in FIG. 3. In synchronization with the rising edge and falling edge of the clock 35, the data signal 34 inputs print data 0 to 15 to the shift register 38 to be stored. At the input timing 70 of the latch trigger 33, the 16-bit data stored in the shift register 38 is held (latched) in the latch 39.

When the data is latched, heaters are sequentially driven in accordance with print data 0 to 15. More specifically, first, the input signals are BE0=BE1=0. Therefore, BLE0 outputs high (H). Since the select signal 30 is H, the heat enable signal 32 is applied to 1, 9, 17, and 25 seg (odd-number seg), which are connected to BLE0 and SEL1, at timing 71.

Next, in accordance with the combination of BE0 and BE1, BLE1, BLE2, and BLE 3 sequentially output H. Therefore, the heat enable signal is applied to four odd-number seg which are connected to SEL1, thereby driving the heaters in accordance with the 16 print data 0 to 15.

Although the above description is provided as to the case of driving 16 odd-number seg (heat drivers), if the select signal 30 is L, 16 even-number seg (heat drivers) are driven in accordance with the print data in a similar manner to the above description.

While ink discharge is performed in accordance with the print data 0 to 15, the data signal 34 inputs 16 print data A to P to the shift register 38 to be stored in synchronization with the rising edge and falling edge of the clock 35.

As has been described above, according to the first embodiment, even in a case where the printhead has orifices which discharge large amounts of ink and orifices which discharge small amounts of ink arranged in a line, the number of bits for the shift register and latch can be cut down to 16 bits, as opposed to 32 heaters. Therefore, an area of the substrate, e.g., silicon, where heaters and driving circuits are formed, can be reduced, thereby enabling cost reduction of the printhead.

[Second Embodiment]

Hereinafter, the second embodiment of the inkjet printhead according to the present invention is described. With respect to the components similar to that of the first embodiment, descriptions thereof are omitted, and characteristic portions of the second embodiment are mainly described.

Figure 8:
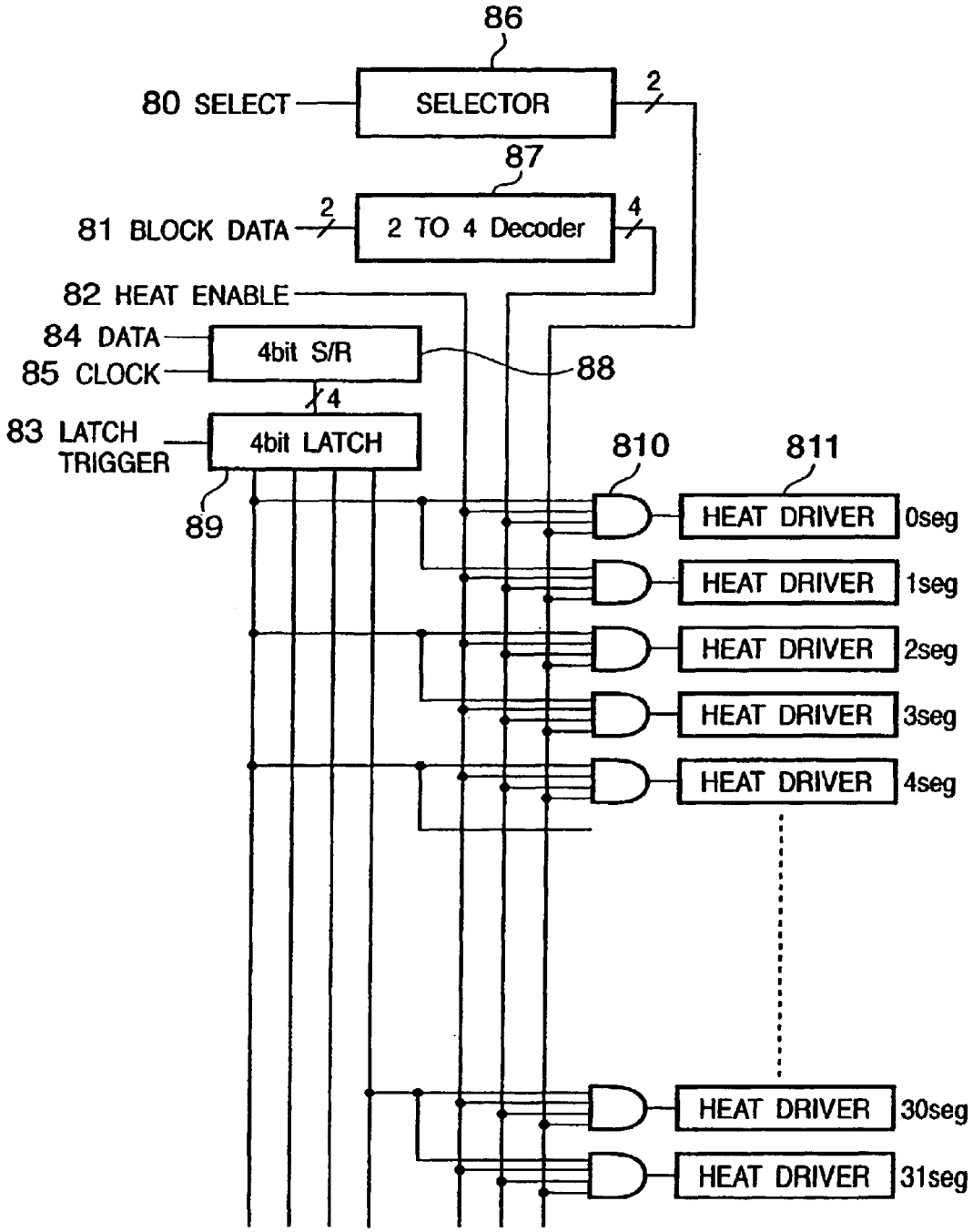
FIG. 8 is a block diagram showing a configuration of a driving circuit of a printhead according to the second embodiment.
Figure 9:
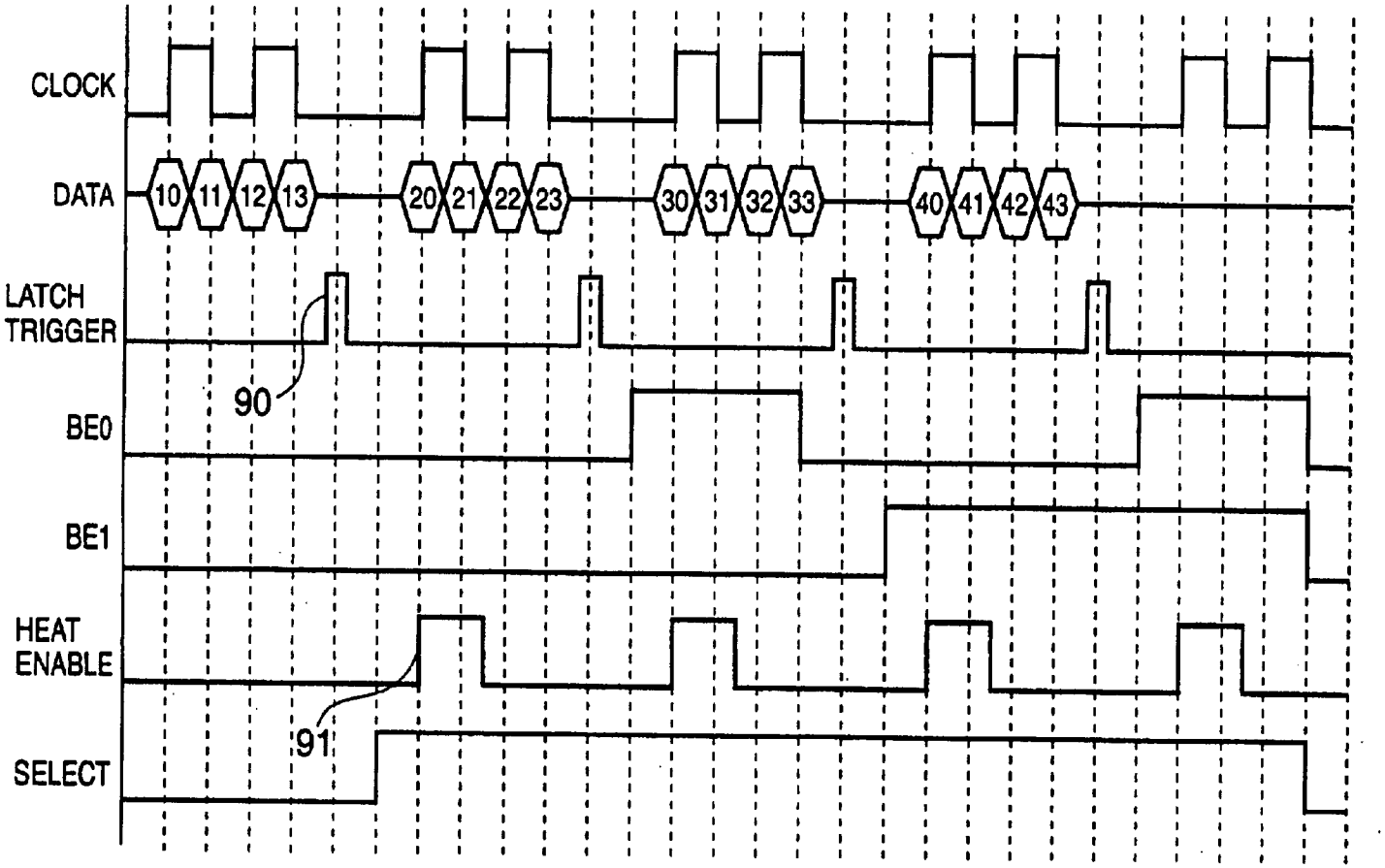
FIG. 9 is a timing chart showing a state of each signal in the circuit shown in FIG. 8.

FIG. 8 is a block diagram showing a configuration of a driving circuit of a printhead according to the second embodiment. FIG. 9 is a timing chart showing a state of each signal shown in FIG. 8.

The printhead according to the second embodiment also has 32 discharge orifices having a similar array as that of the first embodiment. The configuration of the driving circuit shown in FIG. 8 is substantially the same as that of the first embodiment shown in FIG. 3. The selector 86, 2-to-4 decoder 87, AND gates 810, and heat drivers 811 in FIG. 8 respectively correspond to the selector 36, 2-to-4 decoder 37, AND gates 310, and heat drivers 311 in FIG. 3. The input/output characteristics of the 2-to-4 decoder, the input/output characteristics of the selector, and driving condition of each seg (heat drivers) are the same as that of the first embodiment.

The second embodiment differs from the first embodiment on the point that the number of bits for the shift register 88 and latch 89 is cut down to 4 bits (16/4 blocks) which are driven at the same timing. In other words, print data is inputted in units of 4 bits that are simultaneously driven.

Referring to the timing chart in FIG. 9, first, print data 10 to 13 are inputted to the shift register 88 in synchronization with the rising edge and falling edge of the clock 85, and latched in the latch 89 by the latch trigger 90. Based on the latched print data, the heat enable signal 91 is applied to 1, 9, 17, and 25 seg, which are connected to BLE0 and SEL1, thereby driving the heaters.

While ink discharge is performed, print data 20 to 23 are stored in the shift register 88, and latched in the latch 89 by the next latch trigger. The heat enable signal is applied to 3, 11, 19, and 27 seg, which are connected to BLE1 and SEL1, thereby driving the heaters. By repeating the above-described operation, 5, 13, 21, and 29 seg (heat drivers) are driven in accordance with the print data 30 to 33, and 7, 15, 23, and 31 seg (heat drivers) are driven in accordance with the print data 40 to 43.

As has been described above, according to the second embodiment, the number of bits for the shift register and latch can be cut down to 4 bits, as opposed to 32 heaters. Therefore, an area of the substrate, e.g., silicon, where heaters and driving circuits are formed, can be further reduced, thereby enabling cost reduction of the printhead.

[Third Embodiment]

Hereinafter, the third embodiment of the inkjet printhead according to the present invention is described. With respect to the components similar to that of the first and second embodiments, descriptions thereof are omitted, and characteristic portions of the third embodiment are mainly described.

Figure 10:
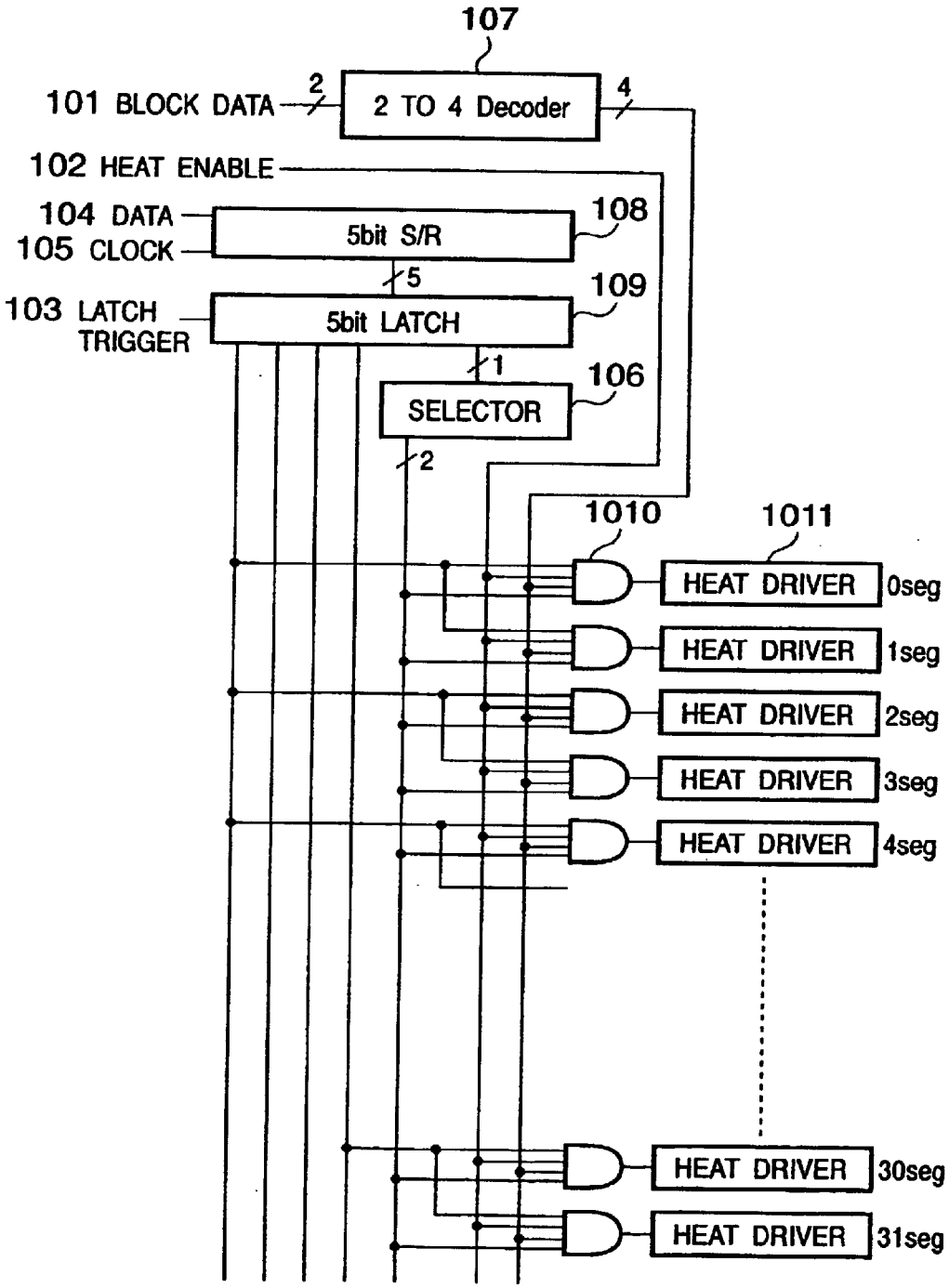
FIG. 10 is a block diagram showing a configuration of a driving circuit of a printhead according to the third embodiment.
Figure 11:
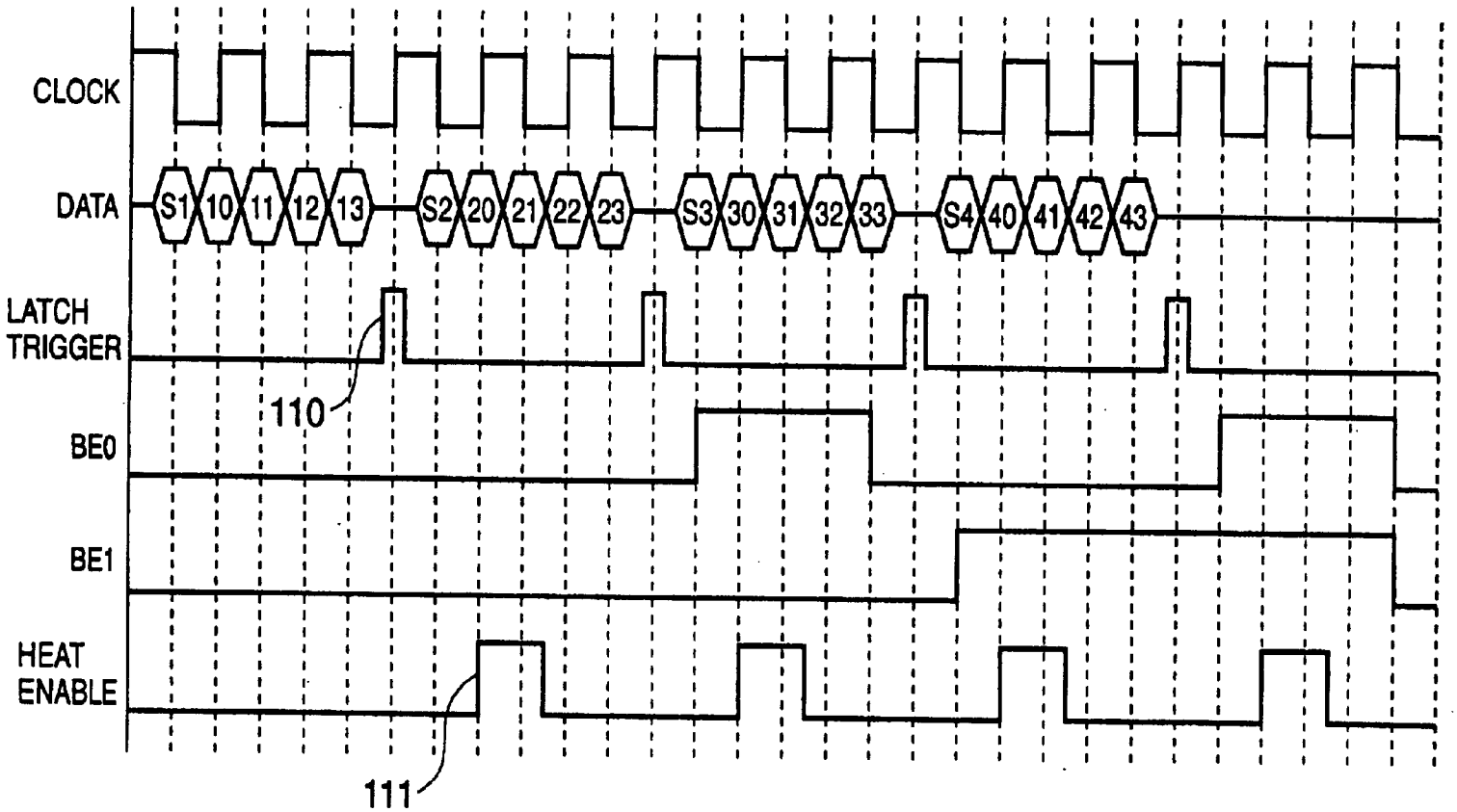
FIG. 11 is a timing chart showing a state of each signal in the circuit shown in FIG. 10.

FIG. 10 is a block diagram showing a configuration of a driving circuit of the printhead according to the third embodiment. FIG. 11 is a timing chart showing a state of each signal shown in FIG. 10.

The printhead according to the third embodiment also has 32 discharge orifices having a similar array as that of the first and second embodiments. The configuration of the driving circuit shown in FIG. 10 is substantially the same as that of the second embodiment shown in FIG. 8. The 2-to-4 decoder 107, AND gates 1010, and heat drivers 1011 in FIG. 10 respectively correspond to the 2-to-4 decoder 87, AND gates 810, and heat drivers 811 in FIG. 8. The input/output characteristics of the 2-to-4 decoder, the input/output characteristics of the selector, and driving condition of each seg (heat drivers) are the same as that of the first embodiment.

The third embodiment differs from the second embodiment on the point that select signals (S1 to S4 in FIG. 11) are transferred to the printhead as a part of the data signal 104. Therefore, the shift register 108 and latch 109 are constructed with 5 bits. Among output signals of the latch 109, an output signal corresponding to the select signal is inputted to the selector 106.

Referring to the timing chart in FIG. 11, the select signal S1 and print data 10 to 13 are inputted to the 5-bit shift register 108 in synchronization with the rising edge and falling edge of the clock 105, and the select data and print data are latched in the 5-bit latch 109 by the latch trigger 110. The select data S1 is inputted to the selector 106, and decoded to SEL0 or SEL1.

The block data BE0 and BE1 are decoded to BLE0 to BLE3 by the 2-to-4 decoder 107. The heat enable signal 111 is applied to four seg, which are connected to one of the decoder outputs BLE0 to BLE 3 and the selector output SEL0 or SEL1, thereby driving the heaters.

As has been described above, according to the third embodiment, the number of bits for the shift register and latch can be cut down to 5 bits, as opposed to 32 heaters. Also, the select signal is incorporated in the data signal, thereby reducing the number of signal lines. Therefore, in addition to the effects of the second embodiment, it is possible to reduce the number of contacts connecting the printer main unit with the printhead, thereby enabling cost reduction of the printhead.

Although the select signal is inputted prior to image data in the above-described third embodiment, the signals may be inputted in reverse. With regard to the subsequent transfer of image data and select signal, a non-signal period may exist between the image data and the select signal.

[Fourth Embodiment]

Hereinafter, the fourth embodiment of the inkjet printhead according to the present invention is described. With respect to the components similar to that of the foregoing embodiments, descriptions thereof are omitted, and characteristic portions of the fourth embodiment are mainly described.

Figure 12:
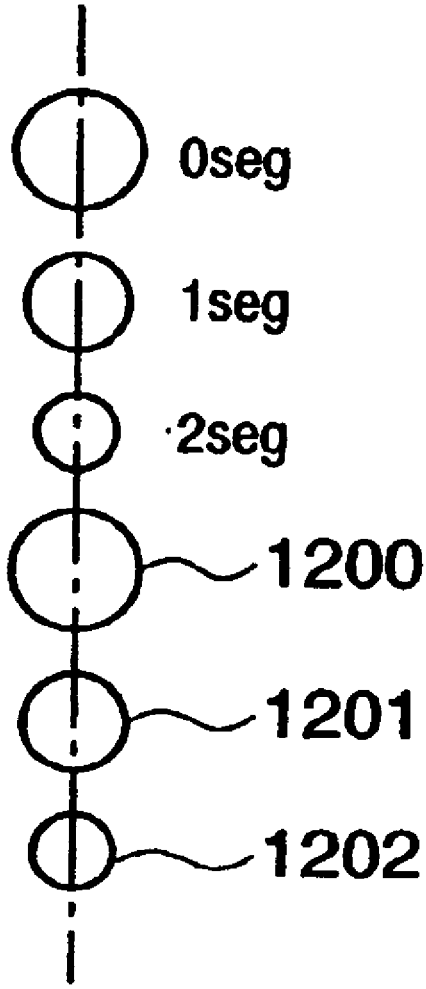
FIG. 12 shows an array of discharge orifices of the printhead according to the fourth embodiment.

FIG. 12 shows an array of discharge orifices of a printhead according to the fourth embodiment. In this embodiment, in order to discharge three types of ink droplets: large, medium, and small ink droplets, a discharge orifice 1200 which discharges a droplet having a large amount of ink, a discharge orifice 1201 which discharges a droplet having a medium amount of ink, and a discharge orifice 1202 which discharges a droplet having a small amount of ink are sequentially arranged at intervals of 1200 dpi. There are 48 discharge orifices, which are referred to as 0seg, 1seg, . . . , 47seg from the top. The amount of ink discharge is about 10 pl for the discharge orifice 1200, about 5 pl for the discharge orifice 1201, and about 2 pl for the discharge orifice 1202.

Since the fourth embodiment has three types of discharge orifices for discharging three different sizes of ink droplets: large, medium, and small sizes, a 2-bit signal is used as a select signal for selecting the type of discharge orifice. Therefore, as shown in the input/output characteristics in FIG. 13, the selector selects one from the three output signals SEL0 to SEL2 in accordance with a state of the 2-bit select signal.

FIG. 14 shows a driving condition of each seg (heat driver) according to the fourth embodiment. As shown in the chart, each seg (heat driver) is driven in accordance with the state of an output signal (BLE0 to BLE 3) of the 2-to-4 decoder and the state of an output signal (SEL0 to SEL2) of the selector. The printhead according to the fourth embodiment is divided into 4 blocks, and in accordance with the signal SEL, the seg corresponding to each size of ink droplets (large, medium, small) is selected.

Besides the portion related to the selector, the configuration of the driving circuit and the timing chart of each signal are the same as that of the first to third embodiments. For instance, with regard to the configuration of the driving circuit, two signals are inputted instead of the select signal 30 or 80 in FIG. 3 or 8, and three signals are outputted from the selector 36 or 86. Furthermore, in contrast to the third embodiment shown in FIG. 10, the shift register 108 and latch 109 are constructed with 6 bits instead of 5 bits, and two signals are inputted to the selector 106 and three signals are outputted from the selector 106.

As has been described above, according to the fourth embodiment, in addition to the effects of the first to third embodiments, it is possible to discharge three types of ink droplets, each having different amounts.

[Fifth Embodiment]

Hereinafter, the fifth embodiment of the inkjet printhead according to the present invention is described. With respect to the components similar to that of the foregoing embodiments, descriptions thereof are omitted, and characteristic portions of the fifth embodiment are mainly described.

Figure 15:
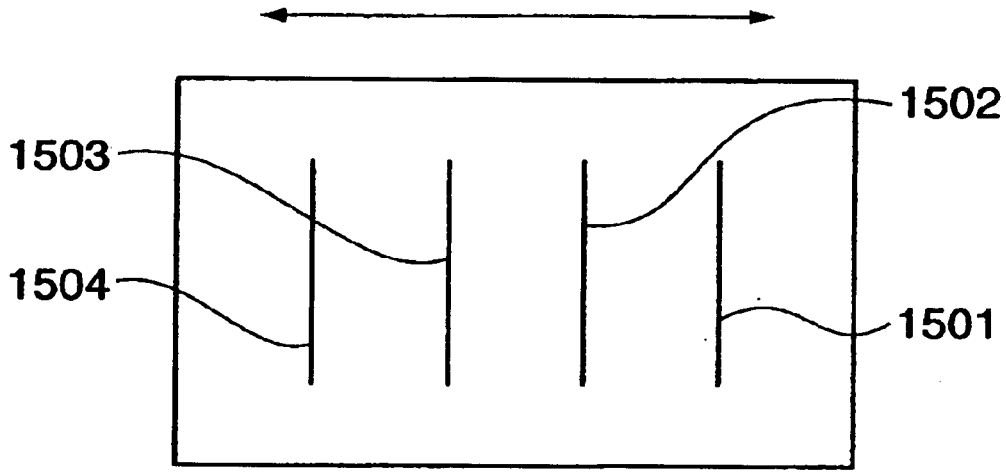
FIG. 15 shows an array of discharge orifices of a printhead according to the fifth embodiment.

FIG. 15 shows a printhead according to the fifth embodiment seen from the discharge orifice side. The arrow in FIG. 15 indicates a printhead scanning direction. Black, cyan, magenta, and yellow ink droplets are respectively discharged from the four arrays of discharge orifices 1501 to 1504, arranged in the scanning direction. Each array of discharge orifices includes a plurality of discharge orifices arranged in the direction intersecting with the scanning direction.

Figure 16:
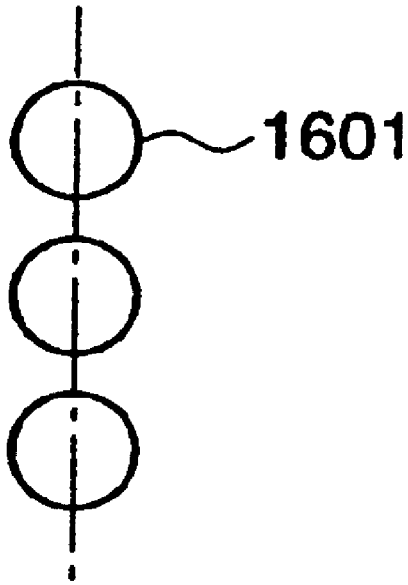
FIG. 16 shows an array of discharge orifices of a black printhead according to the fifth embodiment.

Among the four arrays of discharge orifices, arrays of discharge orifices for cyan, magenta, and yellow have a similar configuration as that of the first embodiment shown in FIG. 2. More specifically, discharge orifices for discharging two types (large and small) of ink droplets are alternately arranged at intervals of 1200 dpi. Meanwhile, with respect to an array of discharge orifices for black, 16 discharge orifices 1601, each discharging an ink droplet of 30 pl, are arranged at intervals of 600 dpi as shown in FIG. 16.

Herein, the configuration of the driving circuit for the arrays of discharge orifices for cyan, magenta, and yellow and the timing chart of respective signals are the same as that of the first or second embodiment. With regard to the driving circuit for the array of discharge orifices for black and the timing chart of black signals, the configuration and the timing chart are the same as that of the first and second embodiments, besides the portion related to the select signal.

FIG. 17 shows the types of signals transmitted to each array of discharge orifices, in a case of driving the printhead of the fifth embodiment in accordance with the processing described in the first or second embodiment. In the chart, "Non" indicates that no signal is necessary. The same reference numerals indicate that the same signal is commonly used. In other words, according to the fifth embodiment, the block data signals (BE0, BE1), latch trigger signal, and clock signal are commonly used for all arrays of discharge orifices, while the select signal and print data signal are different for each array of discharge orifices. With respect to the heat enable signal, a common signal is used for the cyan, magenta, and yellow arrays of discharge orifices, but a different signal is used for the black array of discharge orifices.

Furthermore, in the fifth embodiment, the configuration of the driving circuit for respective arrays of discharge orifices and the timing chart of respective signals may be the same as that of the third embodiment. In this case, the select signal shown in FIG. 17 becomes unnecessary. Instead, data used as a select signal is incorporated in the data signal transmitted to respective arrays of discharge orifices.

As has been described above, according to the fifth embodiment, the size of ink droplets used in printing can be set independently for each color. Therefore, appropriate driving of the printhead can be performed.

[Sixth Embodiment]

Hereinafter, the sixth embodiment of the inkjet printhead according to the present invention is described. With respect to the components similar to that of the foregoing embodiments, descriptions thereof are omitted, and characteristic portions of the sixth embodiment are mainly described.

The printhead according to the sixth embodiment is substantially the same as that of the fifth embodiment. However, the types of signals transmitted to respective arrays of discharge orifices for driving the printhead are different. More specifically, as shown in FIG. 18, in a case of driving the printhead of the sixth embodiment in accordance with the first or second embodiment, a common select signal is used for respective arrays of discharge orifices.

In the above configuration, although the size of ink droplets used in printing cannot be set independently for each color as in the fifth embodiment, it is possible to reduce the number of signal lines between the printer main unit and the printhead. Therefore, it is possible to reduce the number of contacts connecting the printer main unit with the printhead, thereby enabling cost reduction of the printhead.

<First Embodiment of Printhead Substrate>

Next, the first embodiment of a substrate for an inkjet printhead according to the present invention is described with reference to drawings.

Figure 20:
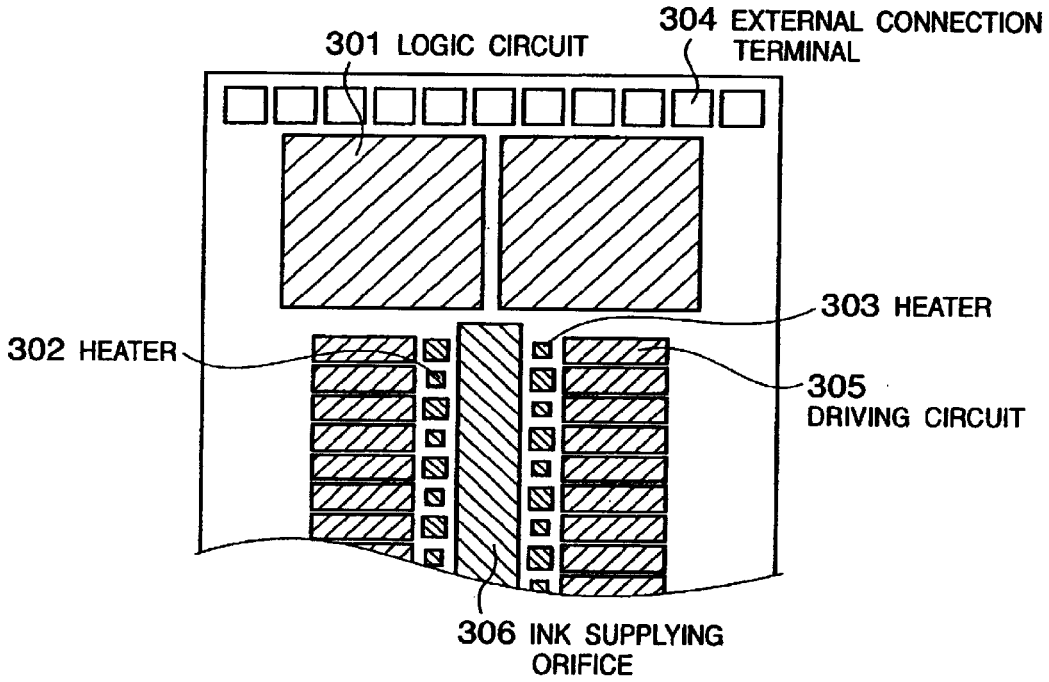
FIG. 20 is a plan view showing a configuration of an embodiment of a substrate for an inkjet printhead according to the present invention.

FIG. 20 is a plan view showing a configuration of an embodiment of a substrate (element board) for an inkjet printhead according to the present invention.

The embodiment shown in FIG. 20 comprises logic circuits 301, heaters (heating elements) 302 and 303, external connection terminals 304, driving circuits 305, and an ink supplying orifice 306.

As the structure of the inkjet printhead, discharge orifices are provided at positions corresponding to each of the heaters as described above, and ink is supplied toward the discharge orifices through an ink channel.

The heaters 302 and 303 have different sizes. The heaters having different sizes, different heating values, and different ink discharge amounts upon being heated, are arranged opposite to each other with the ink supplying orifice 306 on the center. Further, the heating elements having different sizes are alternately arranged in a line on both sides of the ink supplying orifice 306.

The driving circuits 305 are provided corresponding to the respective heaters 302 and 303. Each of the driving circuits 305 drives the corresponding driving element by controlling of the logic circuits 301, which perform operation in accordance with a signal supplied by an external unit through the external connection terminals 304. Since the left and right logic circuits 301 are formed independently from each other with the ink supplying orifice on the center, selection of either side of the heaters enables uniform utilization of the left and right logic circuits. Therefore, it is not necessary to install extra wiring, thus enabling downsizing of the substrate.

Figure 29:
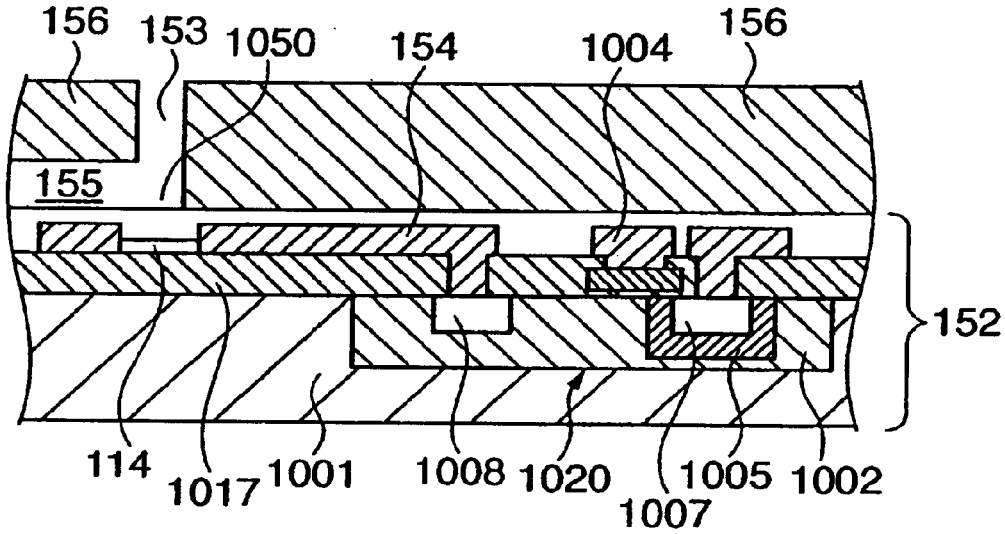
FIG. 29 is a diagrammatic cross-section showing a part of a printhead having a conventional configuration.

This embodiment adopts a DMOS transistor shown in FIG. 29 as the driving circuit 305. Therefore, the circuits can be arranged twice as dense as the conventional arrangement. Accordingly, the heaters 302 and 303 having different sizes can be arranged without increasing the area of the substrate. The logic circuits 301 perform controlling so as to drive heaters of the same size at the same time. Therefore, adjacent heaters are never driven simultaneously, thus enabling stable ink discharge.

Figure 21:
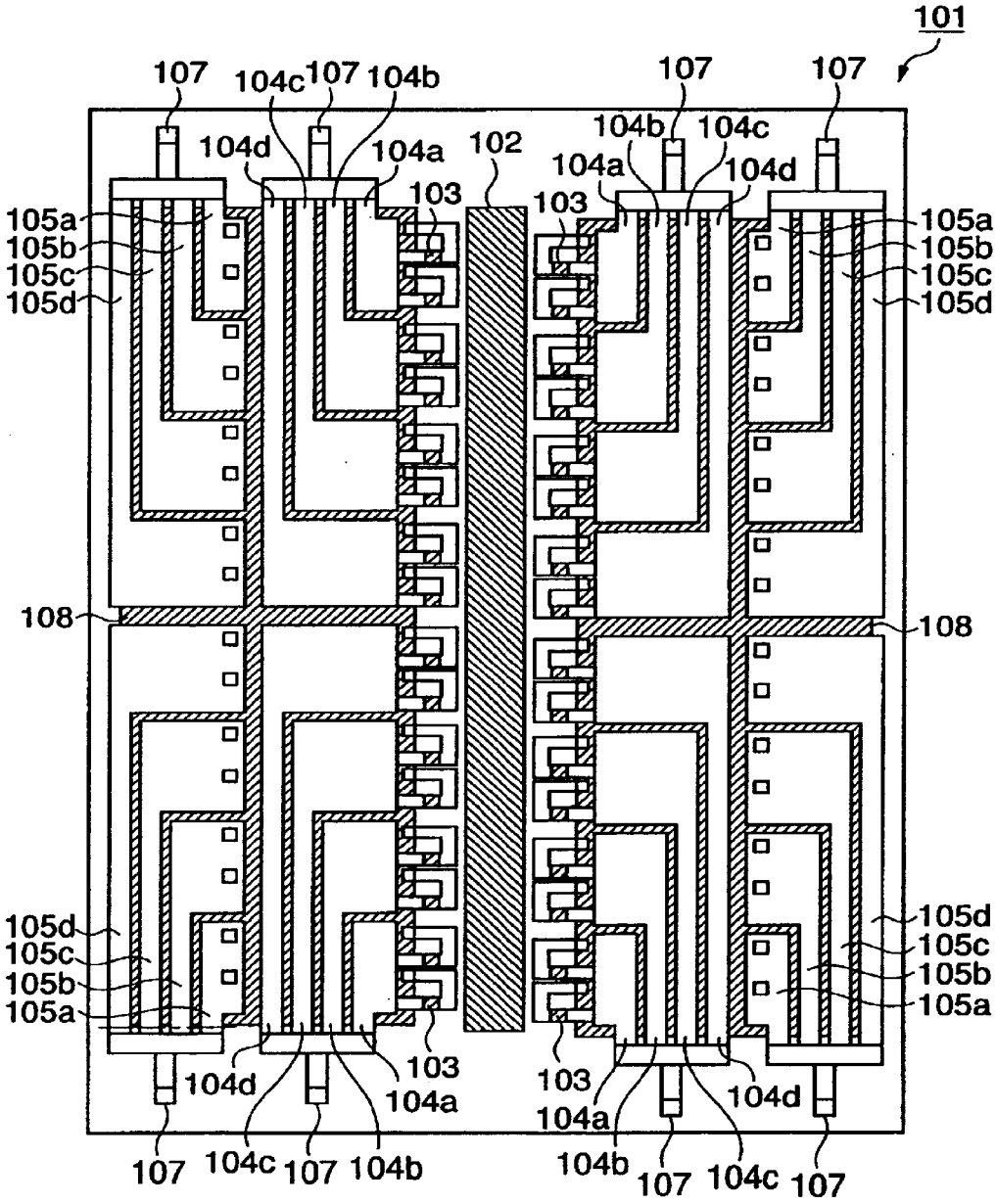
FIG. 21 is a plan view showing detailed wiring on the substrate according to the embodiment shown in FIG. 20.

FIG. 21 is a plan view showing detailed wiring on the substrate according to this embodiment.

Each heater 103 provided on the substrate 101 is configured with the heating elements 302 and 303, which are shown in FIG. 20, and electrode wiring for supplying electric power to the heating elements. One of the wiring of the heater 103 is electrically connected to one of the electrodes 104*a*, 104*b*, 104*c*, and 104*d* which are commonly provided for the power source and potential. The other wiring, serving as a selective electrode, is connected to the driving element 108 comprising a transistor which serves as a switching device. The driving element 108 is connected to electrodes 105*a*, 105*b*, 105*c*, and 105*d* which are commonly provided for the ground (GND) side.

By the configuration of the circuit connected from the electrodes 104*a* to 104*d* in the aforementioned sequence, it is possible to selectively drive respective heaters 103 in accordance with print data, and discharge ink from corresponding discharge orifices. The electrodes 104*a* to 104*d* which are commonly provided for the power source and potential, as well as the electrodes 105*a* to 105*d* are respectively connected to electrode pads 107, thereby being connected to an apparatus power source and a grounded circuit. Note that the ground-side electrodes 105*a* to 105*d* are set so that the wiring resistance becomes equal among the electrodes 104*a* to 104*d*.

Although the heaters 103 having different sizes are arranged opposite to each other with the ink supplying orifice 102 (corresponding to ink supplying orifice 306 in FIG. 20) on the center, any selection of the heaters 103 does not cause uneven utilization of wiring. Therefore, the substrate can deal with a voltage drop, caused by simultaneous driving of the heaters, without increasing the width of the wiring. Accordingly, downsizing of the substrate becomes possible.

Figure 22:
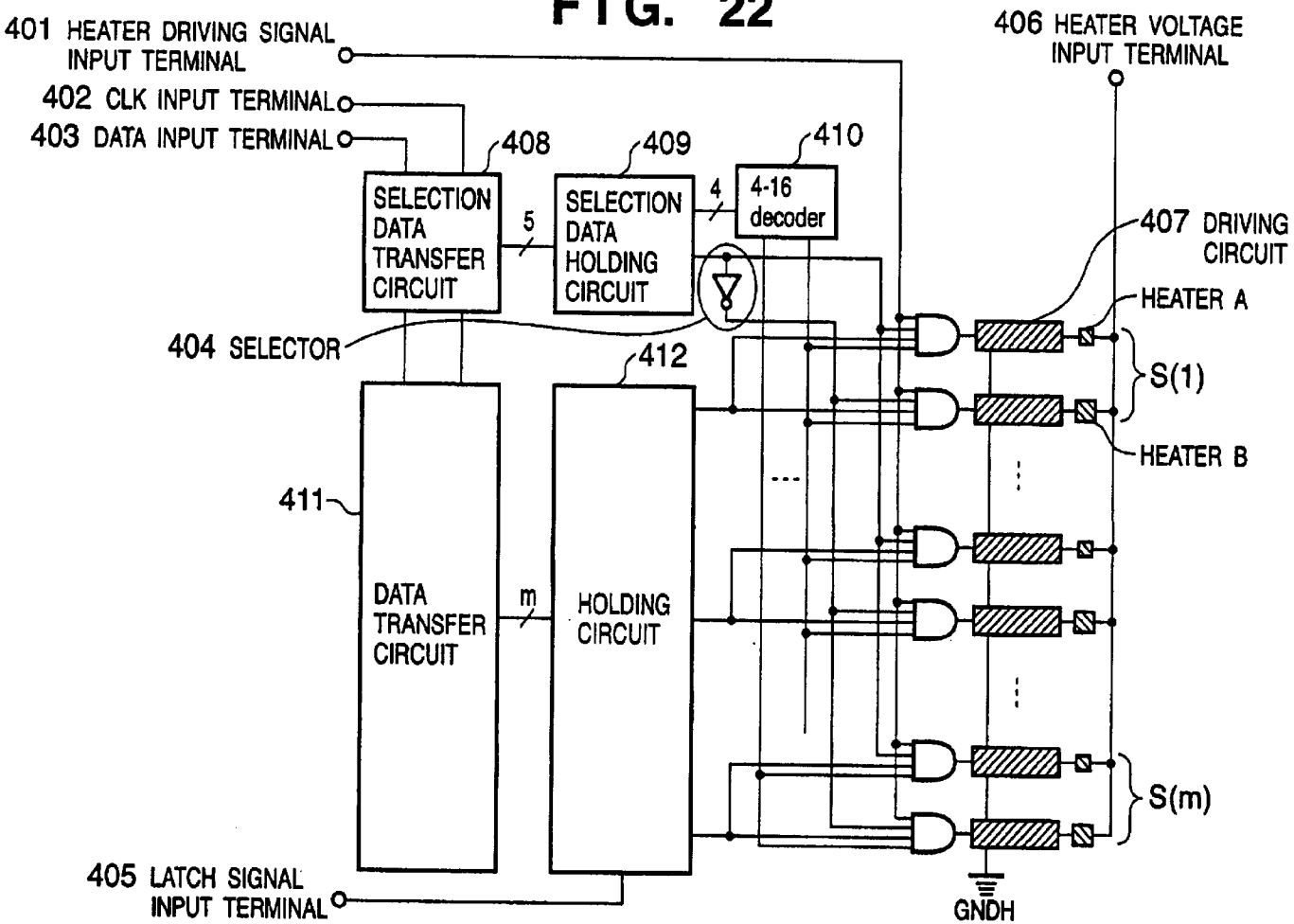
FIG. 22 is a circuit diagram of the logic circuit 301 shown in FIG. 20, shown together with the driving circuits and heaters.

FIG. 22 is a circuit diagram of the circuit construction including the logic circuit 301 shown in FIG. 20, driving circuits and heaters.

The circuit in FIG. 22 comprises a heater driving signal input terminal 401, a clock (CLK) input terminal 402, a data input terminal 403, a selector 404, a latch signal input terminal 405, a heater voltage input terminal 406, driving circuits 407, a selection data transfer circuit 408, a selection data holding circuit 409, a decoder 410, a data transfer circuit 411, a holding circuit 412, and heaters A and B.

The heaters A and B correspond to the heaters 302 and 303 shown in FIG. 20. 2(*n*) types of heaters A and B constitute one group of heaters, and m groups are provided. The driving circuit 407 and AND circuit are provided for each of the heaters A and B. The driving circuit 407 drives the heater in accordance with an output of the AND circuit.

According to this embodiment, the group and type of heaters are selected in accordance with data inputted to the data input terminal 403, and image printing is performed. If the data inputted to the data input terminal 403 relates to data for selecting the group of heaters, the selection data holding circuit 409 outputs the data to the decoder 410, whereas if the inputted data relates to data for selecting the type of heaters, the selection data holding circuit 409 outputs the data to the selector 404. If the inputted data relates to data for printing an image, it is outputted to the data transfer circuit 411.

The holding circuit 412 and data transfer circuit 411 are commonly provided for the heaters A and B. Switching of the heaters A and B is determined by the data inputted to the selection data transfer circuit 408 through the data input terminal 403, and selected by the selector 404.

In FIG. 22, the power source for driving the heaters is supplied from the heater voltage input terminal 406. The power source is connected to end portions of all groups S(1) to S(m) of heaters A and B through the common wiring. The data transfer circuit 411 inputs a serial image data input signal corresponding to each of the groups S(1), S(2), . . . , S(m), which is inputted from the data input terminal 403 through the selection data transfer circuit 408, and a clock input signal for driving the data transfer circuit, which is inputted from the clock input terminal 402 through the selection data transfer circuit 408, and outputs image data to the holding circuit 412 as a parallel signal.

In the holding circuit 412, a latch signal is inputted from the latch signal input terminal 405, and the image data inputted by the data transfer circuit 411 is temporarily stored. Then, the image data is outputted to the AND circuits of corresponding groups S(1), S(2), . . . , S(m).

A driving pulse signal inputted to the heater driving signal input terminal 401 is inputted to respective heaters A and B of the groups S(1), S(2), . . . , S(m).

As described above, the data inputted from the data input terminal 403 to the selection data transfer circuit 408 includes an image data input signal and information regarding the group and type of heaters to be driven. In this embodiment, a 5-bit signal is outputted to the selection data holding circuit 409. Among the inputted 5-bit signal, the selection data holding circuit 409 outputs a 4-bit signal, indicative of the group of heaters to be driven, to the decoder 410, and a 1-bit signal, indicative of the type of heaters to be driven, to the selector 404.

The output terminal of the decoder 410 is connected to respective AND circuits of each of the groups S(1) to S(m). In accordance with the 4-bit signal inputted, the groups to be connected are determined. The selector 404 selects the type of heaters to be driven, i.e., in this embodiment, either heater A or B. As one output of the selector 404, the inputted 1-bit signal is outputted as it is to the AND circuits provided for the heater A. For the other output of the selector 404, the inputted 1-bit signal is inverted by an inverter, and outputted to the AND circuits provided for the heater B. Therefore, the heaters A and B are never selected simultaneously, but only one of them is selected.

According to the present embodiment having the above-described configuration, the group and type of heaters are selected in accordance with data inputted to the data input terminal 403, thereby performing image printing. By virtue of this configuration, it is possible to provide a substrate for an inkjet printhead that can achieve a high tonality without providing a larger number of input terminals than the conventional one.

Note although the first embodiment describes a case where heaters constituting each group have different sizes, heaters having the same size may be used. In this case, one heater may be used for supplementing the other heater in the event of non-discharge of ink.

<Second Embodiment of Printhead Substrate>

Next, the second embodiment of a substrate for an inkjet printhead according to the present invention is described.

Figure 23:
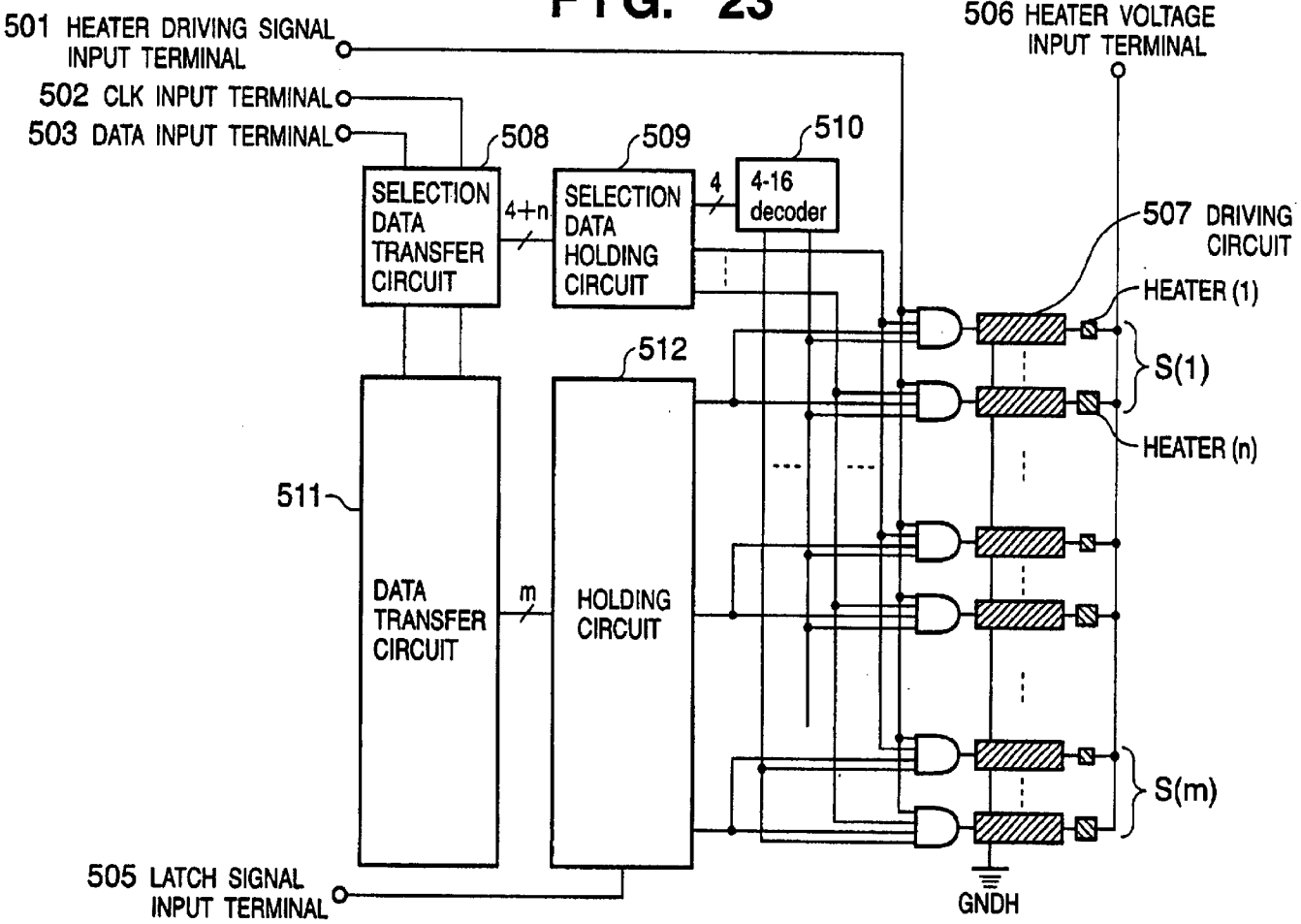
FIG. 23 is a circuit diagram according to another embodiment of the present invention, shown together with driving circuits and heaters.

This embodiment has a different circuit structure of the logic circuit 301 from that shown in FIG. 20. FIG. 23 is a circuit diagram of the logic circuit 301, shown together with the driving circuits and heaters.

In comparison with the types of heaters shown in FIG. 22, the second embodiment has two or more (n) types of heaters, thereby providing a substrate for an inkjet printhead which can achieve a higher tonality.

In the circuit shown in FIG. 23, a heater driving signal input terminal 501, a clock (CLK) input terminal 502, a data input terminal 503, latch signal input terminal 505, a heater voltage input terminal 506, driving circuits 507, a selection data transfer circuit 508, a selection data holding circuit 509, a decoder 510, a data transfer circuit 511, and a holding circuit 512 respectively correspond to the heater driving signal input terminal 401, clock (CLK) input terminal 402, data input terminal 403, latch signal input terminal 405, heater voltage input terminal 406, driving circuits 407, selection data transfer circuit 408, selection data holding circuit 409, decoder 410, data transfer circuit 411, and holding circuit 412 shown in FIG. 22.

This embodiment provides two or more types of heaters. Therefore, the data inputted to the data input terminal 503 includes a 4+n-bit signal for selecting the group and type of heaters to be driven. The selection data transfer circuit 508 outputs the 4+n-bit signal to the selection data holding circuit 509. Among the inputted 4+n-bit signal, the selection data holding circuit 509 outputs the 4-bit signal indicative of the group of heaters to be driven to the decoder 510, then recognizes the type of heaters to be driven based on the n-bit signal indicative of the type of heaters to be driven, and outputs an active signal to the AND circuits provided for the selected type of heaters.

Compared to the foregoing embodiment, since this embodiment having the above-described configuration has an increased number of types of heaters, it is possible to select a larger amount of ink discharge, thereby achieving a higher tonality.

With regard to an arrangement of the n types of heaters, heaters of the same type are arranged opposite to each other in a zigzag manner with the ink supplying orifice on the center. Therefore, as mentioned above, any selection of the heaters 103 does not cause uneven utilization of wiring. Therefore, the substrate can deal with a voltage drop, caused by simultaneous driving of the heaters. Accordingly, downsizing of the substrate becomes possible.

<Configuration of Inkjet Printhead>

Figure 24:
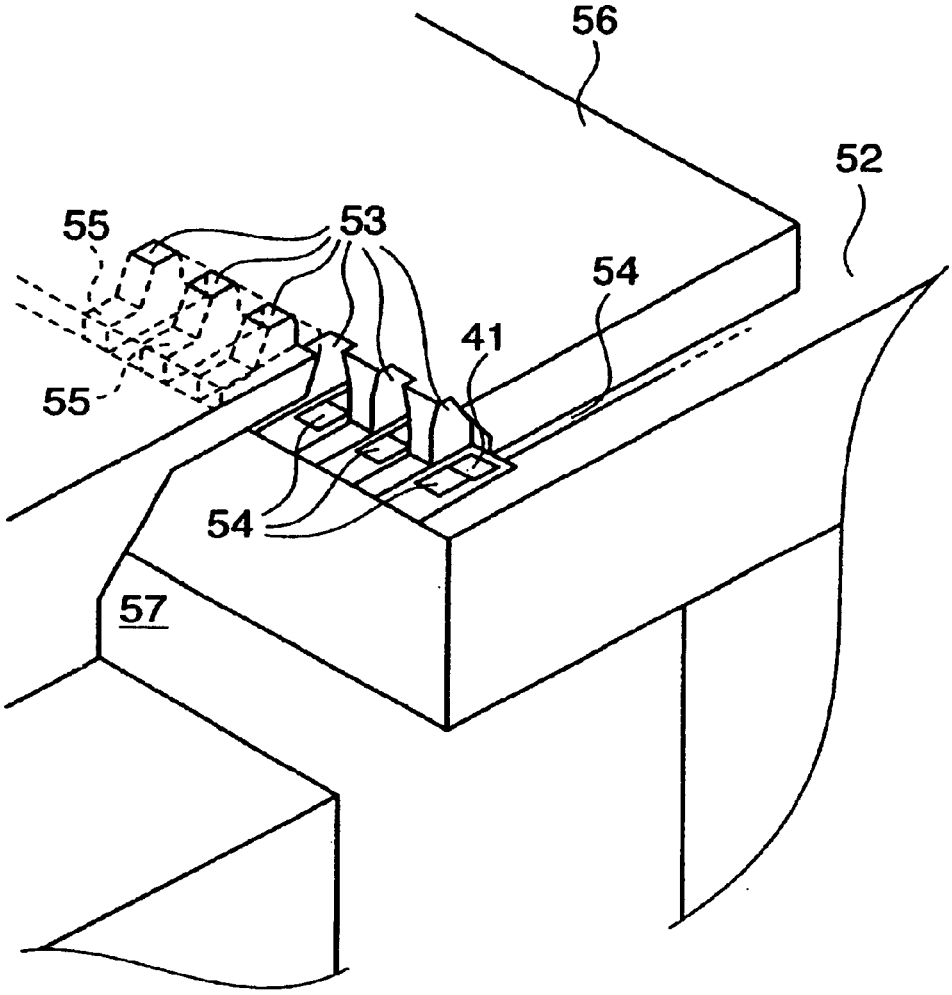
FIG. 24 is a schematic view of an inkjet printhead manufactured with the inkjet printhead substrate shown in FIG. 20 or 23.

FIG. 24 is a schematic view of a configuration of an inkjet printhead manufactured with the inkjet printhead substrate shown in FIG. 20 or 23.

On a device base 52 serving as the inkjet printhead substrate shown in FIG. 20 or 23, plural arrays of electrothermal transducers (heaters) 41 are arranged. The electrothermal transducers 41 are provided for discharging ink from discharge orifices 53 by bubbles generated by heat caused by a flow of current. A wiring electrode 54 is provided for each of the electrothermal transducers. One end of the wiring electrode 54 is electrically connected to the aforementioned switching device 42. Ink channels 55 for supplying ink to the discharge orifices 53, which are located opposite to the electrothermal transducers 41, are provided in correspondence with the respective discharge orifices 53. A wall, which constitutes the discharge orifices 53 and ink channels 55, is configured with a grooved member 56. Attaching the grooved member 56 to the device base 52 forms the ink channels 55 and a common liquid chamber 57 (ink supply port) which supplies ink to the plural ink channels.

Figure 25:
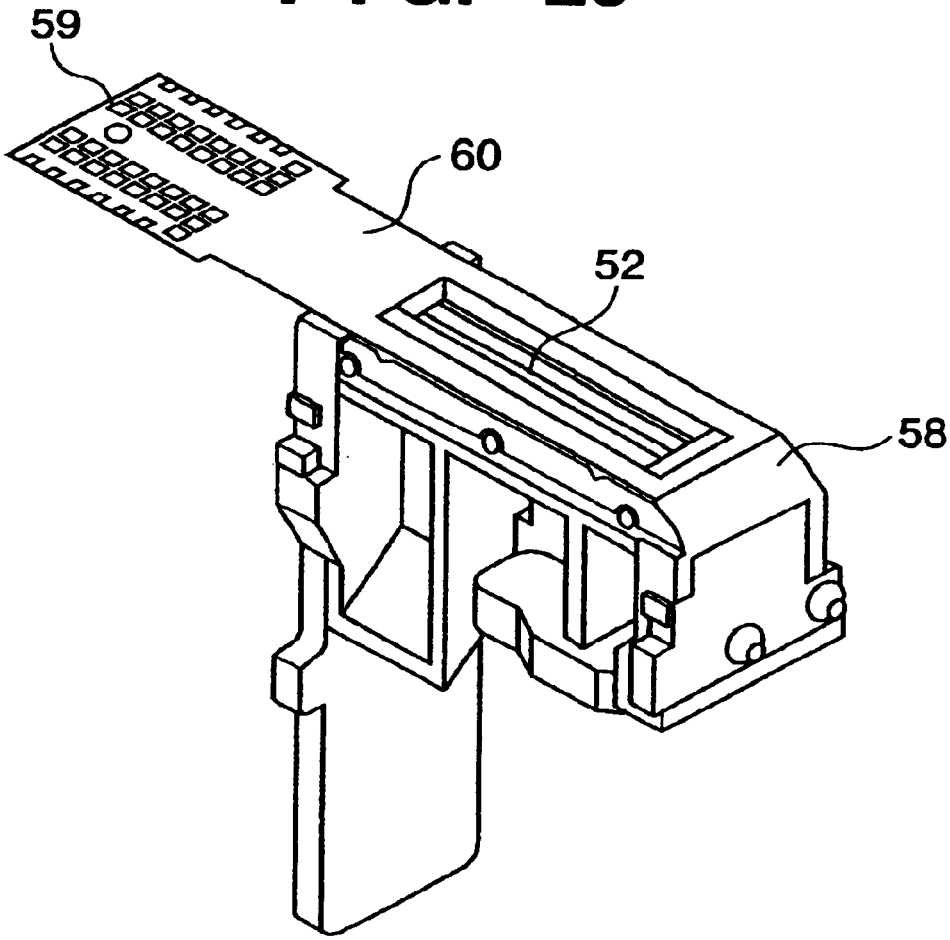
FIG. 25 is a perspective view showing a configuration of an inkjet printhead incorporating a device base 52, serving as an inkjet printhead substrate shown in FIG. 20 or 23.

FIG. 25 shows a configuration of an inkjet printhead incorporating the device base 52, serving as the inkjet printhead substrate shown in FIG. 20 or 23. The device base 52 is incorporated in a frame member 58. The member 56 constituting the discharge orifices 53 and ink channels 55 shown in FIG. 24 is attached to the device base 52. A contact pad 59 for receiving electric signals from the apparatus side is provided. Electric signals representing various driving signals are supplied from a controller of the apparatus main unit to the device base 52 through a flexible print wiring substrate 60.

The above-described inkjet printhead is preferably employed in the aforementioned inkjet printer described with reference to FIGS. 1A and 19.

[Other Embodiment]

Note that although the above-described embodiments have described an example of an inkjet printhead which performs printing by an inkjet printing method and a printer employing the inkjet printhead, the present invention is also applicable to a printhead using a printing method other than the inkjet printing method and a printer employing such inkjet printhead.

In this case, the size of an ink droplet in the above-described embodiments corresponds to the size of a printing element (dot); each discharge orifice (nozzle) or seg corresponds to a printing element of the printhead; and the terms such as "heat" or "discharge" correspond to "drive."

Furthermore, the printing method of the printhead is not limited to a serial method described in the foregoing embodiments. The present invention is applicable to a printer adopting the so-called full-line printing method, which realizes printing by utilizing a printhead, having an array of printing elements corresponding to the length of a printing area, and moving a printing medium relative to the printhead.

Each of the embodiments described above has exemplified a printer, which comprises means (e.g., an electrothermal transducer, and the like) for generating heat energy as energy utilized upon execution of ink discharge, and causes a change in state of an ink by the heat energy. According to this ink-jet printer and printing method, a high-density, high-precision printing operation can be attained.

As the typical arrangement and principle of the ink-jet printing system, those practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note further that excellent printing can be performed by using the conditions described in U.S. Pat. No. 4,313,124, which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention.

In addition, not only an exchangeable chip type printhead, as described in the above embodiment, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

As is apparent, many different embodiments of the present invention can be made without departing from the spirit and scope thereof, so it is to be understood that the invention is not limited to the specific embodiments thereof except as defined in the appended claims.

What is claimed is:

1. An inkjet printhead having an array of printing elements, where first and second printing elements which discharge relatively different amounts of ink are arranged on the same array in a predetermined direction, comprising:

storage means for sequentially storing print data that is serially inputted;

holding means for holding the print data stored in said storage means; and a driving control circuit for driving respective printing elements in accordance with a selection signal indicative of which of the first or second printing element is to be driven, the print data held by said holding means, and a driving signal indicative of a driving period, wherein the print data is inputted to either the first or second printing element, wherein the array of printing elements is provided for at least two colors so as to enable color printing using plural colors, and wherein the selection signal is separately inputted to the at least two arrays of printing elements.

2. The inkjet printhead according to claim 1, wherein the plural colors include cyan, magenta, yellow, and black.

3. The inkjet printhead according to claim 1, wherein the printing elements perform printing by utilizing heat energy.

4. An inkjet printhead having an array of printing elements, where first and second printing elements which discharge relatively different amounts of ink are arranged on the same array in a predetermined direction, comprising:

storage means for sequentially storing print data that is serially inputted;

holding means for holding the print data stored in said storage means; and a driving control circuit for driving respective printing elements in accordance with a selection signal indicative of which of the first or second printing element is to be driven, the print data held by said holding means, and a driving signal indicative of a driving period, wherein the print data is inputted to either the first or second printing element, wherein the array of printing elements is provided for at least two colors so as to enable color printing using plural colors, and wherein the selection signal is commonly inputted to the at least two arrays of printing elements.

5. The inkjet printhead according to claim 4, wherein the plural colors include cyan, magenta, yellow, and black.

6. The inkjet printhead according to claim 4, wherein the printing elements perform printing by utilizing heat energy.

7. A driving method of an inkjet printhead having an array of printing elements, where first and second printing elements which discharge relatively different amounts of ink are arranged on the same array in a predetermined direction, said method comprising:

a data input step of serially inputting print data for the first or second printing element;

a storing step of sequentially storing the inputted print data;

a holding step of holding the stored print data;

a selecting step of inputting a selection signal, indicative of which of the first or second printing element is to be driven;

a driving designation step of inputting a driving signal indicative of a driving period; and a driving control step of driving respective printing elements in accordance with the print data held, the selection signal, and the driving signal, wherein the printhead has the array of printing elements for at least two colors so as to enable color printing using plural colors, and in said selecting step, the selection signal is separately inputted to the at least two arrays of printing elements.

8. A driving method of an inkjet printhead having an array of printing elements, where first and second printing elements which discharge relatively different amounts of ink are arranged on the same array in a predetermined direction, said method comprising:

a data input step of serially inputting print data for the first or second printing element;

a storing step of sequentially storing the inputted print data;

a holding step of holding the stored print data;

a selecting step of inputting a selection signal, indicative of which of the first or second printing element is to be driven;

a driving designation step of inputting a driving signal indicative of a driving period; and a driving control step of driving respective printing elements in accordance with the print data held, the selection signal, and the driving signal, wherein the printhead has the array of printing elements for at least two colors so as to enable color printing using plural colors, and in said selecting step, the selection signal is commonly inputted to the at least two arrays of printing elements.

9. A substrate for an inkjet printhead which discharges ink by utilizing heat energy generated by a plurality of heaters incorporated in the substrate, the heaters divided into m groups, each having n heaters, said substrate comprising:

m x n driving circuits, provided in correspondence with each of the heaters, for driving each of the heaters;

a selection data transfer circuit for separating input data into image data for driving m heaters and a selection signal for selecting m groups and n heaters constituting each group;

a holding circuit for inputting the image data for driving the m heaters, received from said selection data transfer circuit, to supply the image data in units of each group to the heaters constituting each of the m groups; and a selection data holding circuit for inputting the selection signal for selecting the m groups and n heaters constituting each group, received from said selection data transfer circuit, to select the heaters to be driven via said driving circuits, wherein the n heaters are arranged opposite to each other in a zigzag manner with an ink supplying orifice at the center, and said selection data holding circuit selects one of the n heaters constituting each group.

10. The substrate for an inkjet printhead according to claim 9, wherein the n heaters have an equal size, and amounts of ink discharged from the heaters by generated heat energy are equal.

11. The substrate for an inkjet printhead according to claim 9, wherein the n heaters have different sizes, and amounts of ink discharged from the heaters by generated heat energy are different.

12. The substrate for an inkjet printhead according to claim 9, wherein each of said driving circuits is configured with a DMOS transistor.

13. An inkjet printhead employing a substrate for an inkjet printhead which discharges ink by utilizing heat energy generated by a plurality of heaters incorporated in the substrate, the heaters divided into m groups, each having n heaters, said substrate comprising:

m x n driving circuits, provided in correspondence with each of the heaters, for driving each of the heaters;

a selection data transfer circuit for separating input data into image data for driving m heaters and a selection signal for selecting m groups and n heaters constituting each group;

a holding circuit for inputting the image data for driving the m heaters, received from said selection data transfer circuit, to supply the image data in units of each group to the heaters constituting each of the m groups; and a selection data holding circuit for inputting the selection signal for selecting the m groups and n heaters constituting each group, received from said selection data transfer circuit, to select the heaters to be driven via said driving circuits, wherein the n heaters are arranged opposite to each other in a zigzag manner with an ink supplying orifice at the center, and said selection data holding circuit selects one of the n heaters constituting each group.

* * * * *